US008551933B2

(12) United States Patent
Parrish et al.

(10) Patent No.: US 8,551,933 B2
(45) **Date of Patent: *Oct. 8, 2013**

(54) CONCENTRATED FILM DELIVERY SYSTEMS

(75) Inventors: Bryan Parrish, Pleasanton, CA (US); Inderjeet K. Ajmani, Pleasanton, CA (US); Jane Louise Capewell, Pleasanton, CA (US); Bernard Hill, Pleasanton, CA (US); Janiece Hope, Pleasanton, CA (US); Michael Kinsinger, Pleasanton, CA (US); Mona Marie Knock, Pleasanton, CA (US); Rashda Khokhar Khan, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 48 days.

This patent is subject to a terminal disclaimer.

(21) Appl. No.: 13/494,875

(22) Filed: Jun. 12, 2012

(65) Prior Publication Data

US 2012/0258902 A1 Oct. 11, 2012

Related U.S. Application Data

(63) Continuation of application No. 12/793,492, filed on Jun. 3, 2010, now Pat. No. 8,233,238.

(51) Int. Cl.
*C11D 17/00* (2006.01)
*C11D 17/04* (2006.01)

(52) U.S. Cl.
CPC ..... *C11D 17/042* (2013.01)
USPC ..... 510/296; 510/224; 510/283; 510/292; 510/295

(58) Field of Classification Search
USPC ..... 510/224, 283, 292, 295, 296
See application file for complete search history.

(56) References Cited

U.S. PATENT DOCUMENTS

| | | | |
|---|---|---|---|
| 4,176,079 | A | 11/1979 | Guerry et al. |
| 5,824,339 | A | 10/1998 | Shimizu et al. |
| 5,993,854 | A | 11/1999 | Needleman |
| 6,175,054 | B1 | 1/2001 | Jacques |
| 6,683,038 | B2 | 1/2004 | Forth et al. |
| 6,727,215 | B2 | 4/2004 | Roberts et al. |

(Continued)

FOREIGN PATENT DOCUMENTS

| | | |
|---|---|---|
| EP | 509417 | 3/1991 |
| EP | 692194 | 10/2002 |
| WO | WO 03/052043 | 6/2003 |
| WO | PCT/US2011/037696 | 8/2011 |

*Primary Examiner* — Gregory Webb
(74) *Attorney, Agent, or Firm* — Erin Collins

(57) ABSTRACT

A water soluble strip that includes a carrier film that include water soluble polymer, one or more actives and one or more agents such as heat forming agent and/or degrading accelerator. The water soluble strip can optionally include other additives. The actives includes antimicrobial agent, cleaning agent and/or surfactant. The water soluble strip can include other materials. The heat forming agent and/or degrading accelerator, when used, are designed facilitate in degrading or dissolving the water soluble strip and/or increase the activity of the one or more actives. The water soluble film can be used for a variety of applications such as a hard surface cleaning strip, dishwashing strip, laundry cleaning strip, stop removing strip, drain unclogging strip, toilet bowl cleaning strip and the like. The water soluble strip eliminates the need to purchase and store numerous containers and/or heavy containers of cleaner that take up large amounts of shelf space.

20 Claims, 1 Drawing Sheet

(56) References Cited

U.S. PATENT DOCUMENTS

| | | | | |
|---|---|---|---|---|
| 6,737,390 | B2 | 5/2004 | Sunder et al. | |
| 6,812,199 | B2 | 11/2004 | Dasque et al. | |
| 6,815,410 | B2 | 11/2004 | Boutique et al. | |
| 7,446,084 | B2 | 11/2008 | Barthel et al. | |
| 7,517,847 | B2 | 4/2009 | Catalfamo et al. | |
| 7,727,946 | B2 | 6/2010 | Catalfamo et al. | |
| 7,962,976 | B2 | 6/2011 | Peltz et al. | |
| 7,973,003 | B2 | 7/2011 | Peltz et al. | |
| 8,216,993 | B2 | 7/2012 | Peltz et al. | |
| 8,232,238 | B2 * | 7/2012 | Ochomogo et al. | 510/438 |
| 2002/0077264 | A1 | 6/2002 | Roberts et al. | |
| 2002/0123444 | A1 | 9/2002 | Fisher et al. | |
| 2003/0036494 | A1 | 2/2003 | Catlin et al. | |
| 2003/0056301 | A1 | 3/2003 | Dekker et al. | |
| 2003/0104969 | A1 | 6/2003 | Caswell et al. | |
| 2003/0158072 | A1 | 8/2003 | Goodson et al. | |
| 2004/0063603 | A1 | 4/2004 | Dave et al. | |
| 2004/0186039 | A1 | 9/2004 | Sunder et al. | |
| 2004/0253189 | A1 | 12/2004 | Maxwell et al. | |
| 2004/0253190 | A1 | 12/2004 | Maxwell et al. | |
| 2004/0253192 | A1 | 12/2004 | Maxwell et al. | |
| 2004/0253278 | A1 | 12/2004 | Maxwell et al. | |
| 2004/0258733 | A1 | 12/2004 | Maxwell et al. | |
| 2005/0003991 | A1 * | 1/2005 | MacQuarrie | 510/438 |
| 2005/0238697 | A1 | 10/2005 | Chinea et al. | |
| 2006/0039953 | A1 | 2/2006 | Leung | |
| 2006/0258553 | A1 | 11/2006 | Catalfamo et al. | |
| 2007/0099812 | A1 | 5/2007 | Luizzi et al. | |
| 2007/0149435 | A1 | 6/2007 | Koenig et al. | |
| 2007/0167340 | A1 | 7/2007 | Barthel et al. | |
| 2007/0254825 | A1 | 11/2007 | Shannon et al. | |
| 2007/0269651 | A1 | 11/2007 | Denome et al. | |
| 2008/0004202 | A1 | 1/2008 | Wolfgang | |
| 2008/0014393 | A1 | 1/2008 | Denome et al. | |
| 2008/0131695 | A1 | 6/2008 | Aouad et al. | |
| 2008/0145388 | A1 | 6/2008 | Roreger | |
| 2008/0292683 | A1 | 11/2008 | Sanghvi | |
| 2009/0249558 | A1 | 10/2009 | Fileccia | |
| 2010/0062029 | A1 | 3/2010 | Roreger | |
| 2010/0240568 | A1 | 9/2010 | Schmiedel et al. | |
| 2011/0136719 | A1 | 6/2011 | Jalbert et al. | |
| 2012/0245071 | A1 | 9/2012 | Peltz et al. | |

* cited by examiner

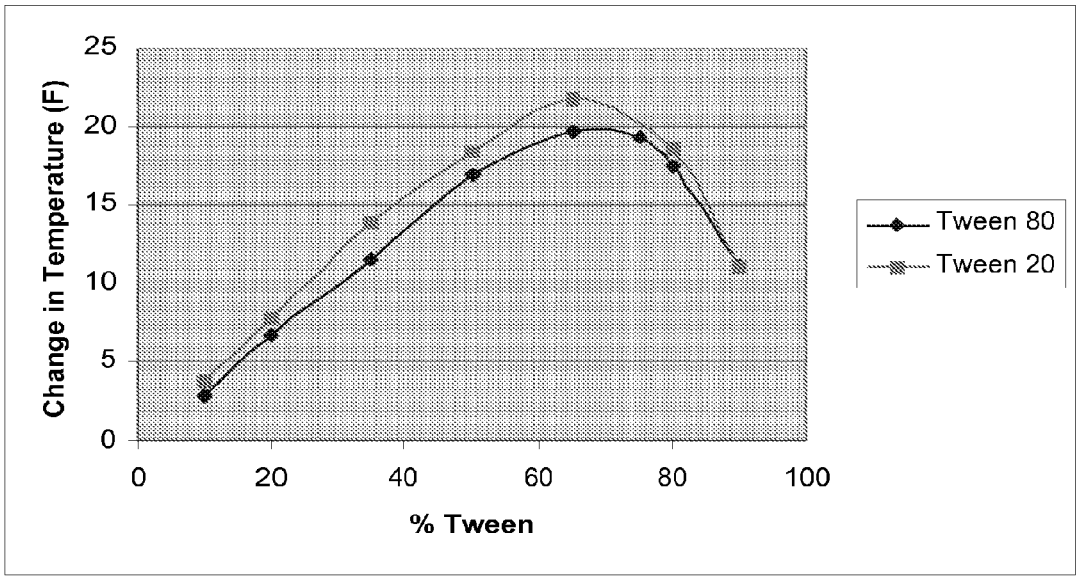
Change in Temperature (F)
25
20
15
10
5
0
0
20
40
60
80
100
% Tween
Tween 80
Tween 20

CONCENTRATED FILM DELIVERY SYSTEMS

The present application is a Continuation of application Ser. No. 12/793,492 to Ochomogo et al., which was filed Jun. 3, 2010 now U.S. Pat. No. 8,233,238 and entitled "Concentrated Film Delivery Systems".

The present invention is directed to concentrated delivery systems, particularly to concentrated delivery systems that include one or more actives in a degradable carrier, more particularly to concentrated delivery systems that include one or more actives in a degradable carrier that degrades or dissolves in the presence of oxygen and/or water, and even more particularly to concentrated film delivery systems that include one or more actives in a degradable polymer film that degrades in the presence of oxygen and/or water.

BACKGROUND OF THE INVENTION

Cleaning products are commonly offered to consumers in ready to use form or in a concentrated form that requires the user to dilute the cleaning product in diluents such as water. Cleaning products such as glass cleaners and hard surface cleaners are commonly offered in spray bottles or liquid containers commonly ranging in size form one quart to one gallon. Some of these cleaning products can be refilled. Such refill containers are typically larger than the container that is used by the consumer. As such, the cleaning product and refill, if available, can take up significant shelf space in a consumer's household. Laundry cleaners are generally offered in liquid or granular form. The liquid laundry cleaners are commonly offered in liquid containers generally ranging in size form one quart to one gallon. Similar to other types of cleaning products, the laundry detergent container can take up significant shelf space in both a consumer's household. Other types of supplemental or specialty cleaners such as laundry stain removers, laundry detergent and/or bleaching additives, spot carpet cleaners, carpet odor removers, toilet bowl cleaners, tile cleaners, drain cleaners and the like are common offered to consumers in aerosol cans or liquid containers that are typically about one quart to half gallon sized containers. All of these different cleaning products require a large amount a shelf space in a consumer's home. In addition, the weight of all these cleaning products on certain types of shelving systems can result damage to the shelf system. Furthermore, the weight of the container can make it difficult for a consumer to hold, carry, lift, remove from a shelf, and restore on a shelf the consumers. Although the offering of certain types of cleaning products in liquid concentrated form can result in a reduction in the size of the cleaning product container, many concentrates are offered to consumers in the same container size, but offer more uses per container due to the concentrated form of the cleaner. As such, the shelf spacing and weight issues of such cleaners is not addressed by concentrated cleaning liquids.

Unit dose cleaning products are available for laundry applications and dishwasher applications, but these products typically come in tablet or pouch forms which take a long time to dissolve in water. Usually, the time it takes to dissolve exceeds 2 minutes and sometimes is as much as 5 minutes or more. One of the problems with these unit dose products is that they do not contain actives on or in the exterior portion of the film (for a pouch) or on the surface of a tablet which aid in the dissolving the product quickly and effectively in water.

In view of the current state of the art of cleaning products, there is a need for a cleaning product concentrate that is convenient to store, takes up less shelf space than typical liquid or granular cleaners, is convenient and easy to use, and which is at least as effective as standard liquid, liquid concentrate, aerosol or granular cleaning products.

SUMMARY OF THE INVENTION

The present invention is directed to concentrated delivery system that overcomes many of the past problems associated with prior delivery systems. The present invention is directed to a water soluble strip that includes a carrier film and one or more actives contained on and/or in the carrier film. The carrier film is formed of one or more polymers. One or more actives are coated on and/or embedded in the carrier film. The water soluble strip can include additional additives that can be used to 1) modify the rate of release of one or more actives from the water soluble strip, 2) modify the physical properties of the carrier film and/or water soluble strip, 3) modify the rate of degradation of the carrier film, 4) modify the activity and effectiveness of one or more of the actives, 5) modify the appearance, color and/or texture of the water soluble strip prior to and/or during the degradation of the water soluble strip in water, and/or 6) modify the color and/or surface texture of the cleaning solution during and/or after the degradation of the water soluble strip in water. The use of a water soluble strip having one or more actives has many potential uses for a consumer. The type and amount of active included in the water soluble strip is dependent on the use of the water soluble strip. For laundry applications, the one or more actives in the water soluble strip can include peroxide, bleach, enzymes, detergent, and the like. For hard surface cleaning applications, the one or more actives in the water soluble strip can include ammonia, alcohol, pine oil, disinfectant, detergent, antimicrobial agent, and the like. The shape, size and thickness of the water soluble strip is non-limiting. Generally the water soluble strip is a thin strip so as to rapidly dissolve or degrade in the presence of oxygen and/or water. In one non-limiting embodiment, the thickness of the water soluble strip is at least about 0.01 mm and less than about 5 mm. The size of the strip is generally about 1-50 cm wide and about 1-50 cm long. The water soluble strip generally has a square or rectangular shape; however, this is not required. The surface of the water soluble strip can be smooth or rough. The color of the water soluble strip can be clear, opaque or colored.

One non-limiting use of the water soluble strip of the present invention is a water soluble strip in the form of a dishwasher cleaning strip. In such an application, the dishwasher cleaning strip is placed in the dishwasher by-it-self or in conjunction with dishwasher cleaning liquid or granules. Once the dishwasher is turned on, the water in the dishwasher causes the dishwasher cleaning strip to degrade and/or dissolve and to release one or more actives (e.g., cleaning agents, water softeners, sheeting agents, fragrances, etc.) into the dishwasher so as to clean the items in the dishwasher. The dishwasher cleaning strip can be used as the sole cleaning agent in the dishwasher or be used as a supplement to other cleaning agents placed in the dishwasher. The use of a dishwasher cleaning strip can make the dishwasher cleaning process easier and more convenient. The user of the dishwasher cleaning strip merely needs to place a single dishwasher cleaning strip anywhere in the dishwasher and then start the dishwasher. The measuring of dishwashing liquids or granules is eliminated. The need to place the dishwashing liquid or granules into a certain holder or container in the dishwasher is eliminated. Additionally, the dishwasher cleaning strips are small and thin strips, thus are light weight and require little storage space. As such, the dishwasher cleaning strips are ergonomically advantageous as compared to standard dishwashing cleaning granules and liquids. The need to lift, store and use large and/or heavy containers of dishwashing detergent can be eliminated by the use of the dishwasher cleaning strips in accordance to one non-limiting aspect of the present invention.

Another non-limiting use of the water soluble strip of the present invention is a water soluble strip in the form of a hard surface cleaning strip and/or glass cleaning strip. In such an application, the cleaning strip is placed in a container prior to, during and/or after a diluent (e.g., water) is placed into the container. Upon contact with the diluent in the container, the cleaning strip rapidly degrades and/or dissolves to thereby release the one or more actives (e.g., cleaning agents, polishing agents, odor removing agents, fragrances, disinfectants, etc.) into the diluent. After the cleaning strip is dissolved, the user can then apply the liquid in the container to a glass surface, hard surface (e.g., wood floors and/or countertops, tile floors and/or countertops, granite, concrete, engineered stone or stone floors and/or countertops, linoleum floors and/or countertops, corian countertops, etc.) so as to clean such surface. The cleaning strip may include an additive that changes the color of the diluent to indicate that the diluent containing the one or more actives from the cleaning strip is ready to use; however, this is not required. The cleaning strip can be designed for user in standard sized containers (16-32 ounce containers); however, the cleaning strip can be designed for use in smaller and larger volume containers. The cleaning strips can be used by a consumer to refill a container of cleaning product, and/or the consumer can use a generic container and use such strips in such generic container to formed the desired cleaning product. In most households, a consumer stores in one or more locations in a household one or more bottles of window cleaner, counter cleaner, floor cleaner, etc. Sometime the consumer also stores one or more refill bottles for such cleaners. During spring cleaning or other cleaning events, multiple containers of cleaning product can be used by the consumer. The cleaning strips of the present invention can make the glass and/or hard surface cleaning process easier and more convenient. The user of the cleaning strip merely needs to place a single cleaning strip in a container, add a diluent to the container, and then use the cleaning solution that was rapidly formed in the container to clean a glass and/or hard surface. No pre-measuring of cleaning concentrate is required. The need for a consumer to purchase and store multiple containers or refill containers of cleaning solution is eliminated by the cleaning strips. The need to refill containers with cleaning solution from a refill container is also eliminated by the cleaning strips. Additionally, the cleaning strips are small and thin strips, thus are light weight and require little storage space. As such, the cleaning strips are ergonomically advantageous as compared to storing multiple cleaning containers or refill containers of cleaning solution. Although the cleaning strips described above were described for forming cleaning solutions to clean glass and/or hard surfaces, it can be appreciated that the cleaning strips can be formulated form other types of solutions (e.g., odor removers, carpet cleaners, carpet spot removers, furniture cleaners, furniture polish, appliance cleaners, toilet bowl cleaners, shower cleaners, soap scum cleaners, hard water stain cleaners, grout cleaners, stainless steel cleaners, tire cleaners, vehicle cleaners, leather cleaners, vinyl cleaners, etc.).

Still another non-limiting use of the water soluble strip of the present invention is a water soluble strip in the form of a laundry cleaning strip. In such an application, the laundry cleaning strip is placed in the washing machine by-it-self or in conjunction with one or more other types of laundry cleaning liquids or granules. Once the washing machine is turned on, the water in the washing machine causes the laundry cleaning strip to degrade and/or dissolve and to release one or more actives (e.g., cleaning agents, water softeners, bleaching agents, fabric softeners, whiteners, color protectors, fragrances, disinfectants, etc.) into the washing machine so as to clean and/or otherwise treat the items in the washing machine. The laundry cleaning strip can be used as the sole laundry cleaning agent in the washing machine or be used as a supplement to other laundry cleaning agents placed in the washing machine. The use of a laundry cleaning strip can make the laundry cleaning process easier and more convenient. The user of the laundry cleaning strip merely needs to place a single laundry cleaning strip in the washing machine (i.e., before, during or after the items have been placed in the washing machine) and then start the washing machine. For larger than normal laundry loads, the consumer may need to place two or more cleaning strips on the washing machine. The measuring of liquid or granular laundry detergent is eliminated by the user of the laundry cleaning strip of the present invention. The need to place liquid or granular laundry detergent in a certain holder or container in the washing machine is eliminated. Additionally, the laundry cleaning strips are small and thin strips, thus are light weight and require little storage space. As such, the laundry cleaning strips are ergonomically advantageous as compared to standard liquid and granular laundry detergents. The need to lift, store and use large and/or heavy containers of laundry detergent can be eliminated by the use of laundry cleaning strips in accordance to one non-limiting aspect of the present invention.

Yet another non-limiting use of the water soluble strip of the present invention is a water soluble strip in the form of a toilet bowl cleaning strip. In such an application, the toilet bowl cleaning strip is placed in the toilet bowl. Once the toilet bowl cleaning strip is placed in the toilet bowl that container water, the water in the toilet bowl causes the toilet bowl cleaning strip to degrade and/or dissolve and to release one or more actives (e.g., cleaning agents, disinfectants, fragrances, bleaching agent, etc.) into the toilet bowl. The toilet bowl cleaning strip may include an additive that changes the color of the water in the toilet bowl to indicate that the toilet bowl is ready to be cleaned; however, this is not required. The toilet bowl cleaning strip may include heat forming agents that generate heat after the toilet bowl cleaning strip is placed into the toilet bowl that container water so as to facilitate in the cleaning of the toilet bowl; however, this is not required. The toilet bowl cleaning strip may include an additive that foams in the water in the toilet bowl to indicate that the toilet bowl is ready to be cleaned and/or to facilitate in the cleaning of the toilet bowl; however, this is not required. The use of a toilet bowl cleaning strip can make the toilet bowl cleaning process easier and more convenient. The user of the toilet howl cleaning strip merely needs to drop a single toilet bowl cleaning strip into the toilet bowl and then proceed to clean the toilet bowl. The decision regarding how much liquid toilet cleaner or spray toilet cleaner needed to be used to properly clean the toilet bowl is eliminated by the use of the toilet bowl cleaning strip of the present invention. Additionally, the toilet bowl cleaning strips are small and thin strips, thus are light weight and require little storage space. As such, the toilet bowl cleaning strips are ergonomically advantageous as compared to standard liquid or spray toilet bowl cleaners. The need to store and use containers of toilet bowl cleaner can be eliminated by the use of toilet bowl cleaning strips in accordance to one non-limiting aspect of the present invention.

Still yet another non-limiting use of the water soluble strip of the present invention is a water soluble strip in the form of a drain cleaning strip. In such an application, the drain cleaning strip is placed in the toilet, sink, shower, etc. that has a clogged drain. Once the drain cleaning strip is placed in or near the clogged drain, the water in or about the clogged drain causes the drain cleaning strip to degrade and/or dissolve and to release one or more actives (e.g., drain cleaning agents, disinfectants, fragrances, etc.) into the clogged drain. The drain cleaning strip may include an additive that changes the color of the water to indicate that the drain cleaning strip is releasing drain cleaning agents; however, this is not required. The drain cleaning may include heat forming agents that generate heat after the drain cleaning strip is place at or near a clogged drain so as to facilitate in the unclogging process; however, this is not required. The drain cleaning strip may include an additive that foams to indicate that the drain cleaning strip is releasing drain cleaning agents and/or to facilitate in the unclogging of the drain; however, this is not required. The use of a drain cleaning strip can make the drain unclogging process easier and more convenient. The user of the drain cleaning strip merely needs to drop a single drain cleaning strip into the toilet, sink, shower, etc. that has a clogged drain. The decision regarding how much liquid or granular drain cleaner needed to unclog a drain is eliminated by the use of the drain cleaning strip of the present invention. Additionally, the drain cleaning strips are small and thin strips, thus are light weight and require little storage space. As such, the drain cleaning strip are ergonomically advantageous as compared to standard liquid or granular drain cleaners. The need to store and use containers of drain cleaner can be eliminated by the use of drain cleaning strips in accordance to one non-limiting aspect of the present invention.

Another non-limiting use of the water soluble strip of the present invention is a water soluble strip in the form of a laundry stain cleaning strip. In such an application, the laundry stain cleaning strip is placed on a stain that is located on a piece of clothing. Currently, stain removal products such as Spray & Wash™ Shout™, etc. are applied to tough to remove stains (e.g., blood, oil, ink, heavily soiled areas, etc.) prior to hand washing the clothing item or placing the clothing item into the washing machine. The laundry stain cleaning strip can include an adhesive or tacking agent to facilitate in securing the laundry stain cleaning strip to the clothing item; however, this is not required. In one embodiment, the laundry stain cleaning strip may contain a water soluble or water dispersible adhesive which contains active ingredients to pretreat and/or deliver targeted stain removal to a portion of a textile item. The laundry stain cleaning strip may comprise one of the following embodiments: an adhesive loaded with actives which treat the stained textile directly, or an adhesive strip with a backing layer where the backing layer may be merely a non-active layer of material which aids in easy application of the adhesive strip to the textile material, or an adhesive strip in combination with one or more cleaning water soluble strips and an optional backing layer wherein at least one of the adhesive strips or cleaning strips contain actives for treating laundry stains. Alternatively or additionally, the stained region can be wetted prior to and/or after the laundry stain cleaning strip is applied to the stained region on the clothing item so as to facilitate in securing the laundry stain cleaning strip to the clothing item; however, this is not required. In one embodiment, the laundry stain strip may be capable of adhering to both wet and/or dry clothing or textile items. The adhesive strip may comprise chemical adhesives and/or non-chemical adhesive means of attaching the strip to the clothing or textile item, such as static based adhesion (e.g. Lectex®), pressure sensitive adhesion, "Gecko" adhesion (using high surface area and van der waals forces), physical adhesion (Velcro®, hook and loop, etc.) The laundry stain cleaning strip may include heat forming agents that generate heat after the laundry stain cleaning strip is applied to the clothing item so as to indicate that the laundry stain cleaning strip is beginning the stain cleaning process (i.e., tactile feel of heat by the user) and/or to facilitate in the removing of the stain from the clothing; however, this is not required. The laundry stain cleaning strip may include an additive that foams to indicate that the laundry stain cleaning strip is beginning the stain cleaning process and/or to facilitate in the removing of the stain from the clothing; however, this is not required. Once the laundry stain cleaning strip is placed on the stained region of the clothing item, the clothing item and the laundry stain cleaning strip can be placed in a washing machine for cleaning or the user can place the clothing item in a sink to be hand washed. While the laundry stain cleaning strip is in contact with the water in the washing machine or sink, the water causes the laundry stain cleaning strip to degrade and/or dissolve and to begin releasing or further release one or more actives (e.g., cleaning agents, water softeners, bleaching agents, fabric softeners, whiteners, color protectors, fragrances, disinfectants, etc.) onto the clothing item so as to facilitate in cleaning the stain on the clothing item. The laundry stain cleaning strip can be used as the sole laundry cleaning agent for cleaning the stain on the clothing item or be used as a supplement to other laundry cleaning agents. The use of a laundry stain cleaning strip can make the stain cleaning process easier and more convenient. The user of the laundry stain cleaning strip merely needs to place a single laundry stain cleaning strip on the stained region of the clothing item to begin the stain cleaning process. The determining of how much cleaning stain cleaning agent should be applied to the stain on the clothing item is eliminated by use of the laundry stain cleaning strip. Additionally, the laundry stain cleaning strip is small and thin strips, thus are light weight and require little storage space. As such, the laundry stain cleaning strip is ergonomically advantageous as compared to standard laundry stain liquid or spray cleaners. The need to store and use containers of laundry stain cleaner can be eliminated by the use of laundry stain cleaning strip in accordance to one non-limiting aspect of the present invention. The laundry stain cleaning strip can be formulated to be a general stain remover to facilitate in removing a wide variety of stains. Alternatively, the laundry stain cleaning strip can be formulated to remove certain types of stains. For example, one type of laundry stain cleaning strip can be used to remove grass stains from clothing items. Another type of laundry stain cleaning strip can be used to remove blood stains from clothing items. As can be appreciated, the stain cleaning specifics of the laundry stain cleaning strip can be as broad or as narrow as desired based on the active formulation in the laundry stain cleaning strip. The applications of the water soluble strip set forth above are merely non-limiting examples of the potential applications for the water soluble strip of the present invention. The water soluble strip of the present invention can have other or additional cleaning applications.

In one non-limiting aspect of the present invention, the laundry stain cleaning strip film of the present invention includes one or more water-soluble adhesives. The one or more water soluble adhesives are formulated to partially or fully dissolve when exposed to water to thereby release one or more actives that are coated on and/or contained in the water soluble laundry strip. Many different water soluble adhesives can be used to at least partially form the laundry strip. Non-limiting examples of water soluble adhesives include, but are not limited to; PVP, glycerine, borax, sugars, proteins, acrylates, pasty surfactants (including but not limited to, betaines, block copolymers, etc.), Polymers that adhere but also suspend dirt and soils, polysaccarides, polyols, adhesives using hydrogen bonding, PEGs, Pluronics®, cationic polymers—poly(DADMAC), chitosan, poly(Quats), Polyelectolyte Complexes (PECs), coacervates, gums (e.g., pectin, guar, etc.), modified cellulose (e.g. CMC, HPMC, HEMC, HPC), modified starch, (e.g. PEO, PPO, and block copolymers thereof), hydroxy alkyl acrylates, hydroxy alkyl methacrylates, alkyl or hydroxy alkyl ethers, vinyl esters, polyacrylic acid, Gantrez® (maleic anhydride/methylvinyl ether copolymers from ISP), Gafquat® (PVP/quat copolymer from ISP), plasticizers or tackifiers (e.g. PEO, PPO, polyhydric alcohols (glycerin, sorbitol, terpenes, combination of two materials, one low MW and one high MW, and any combinations or permutations thereof.

In one non-limiting aspect of the present invention, the carrier film used in the water soluble strip of the present invention includes one or more water-soluble polymers. The one or more water soluble polymers are formulated to partially or fully dissolve when exposed to water to thereby release one or more actives that are coated on and/or contained in the water soluble strip. Many different water soluble polymers can be used to at least partially form the carrier film. Non-limiting examples of water soluble polymers include cellulose derivatives (e.g., micro-crystalline cellulose; hydroxypropylcellulose, hydroxypropylmethylcellulose, hydroxyethylcellulose, methylcellulose, carboxymethylcellulose, sodium carboxy-methylcellulose, etc.), polyvinylpyrrolidone, acrylate polymers (e.g., sodium poly-acrylate, acrylic homopolymers and copolymers, copolymers of acrylamide and sodium acrylate, etc.), alcohol polymers (e.g., polyvinyl alcohol, etc.), alginates (e.g., sodium alginate, etc.), starches (i.e., natural and chemically modified), glycerin, proteins (e.g., gelatin, wheat gluten, milk proteins, etc), gums (e.g., guar gum, locust gum, tara gum, agar gum, xanthan gum, etc.) polysaccharides (e.g., starches [i.e., natural and chemically modified], chitosan, maltodextrin, pectin, xanthan gum, guar gum, gum arabic, algin, pullulan, etc.), sorbitol, seaweed, synthetic polymers (e.g., polyvinyl alcohol [i.e., PVA or PVOH], polymethylvinylether (PVME), poly-(2-ethyl 2-oxazoline), polyvinylpyrrolidone, etc.), proteins (e.g., whey, soy, collagen, etc.), polystyrene sulfonates, polyampholytes, and polyethyleneimines. Non-limiting examples of water soluble polymers that can be used in the water soluble strip of the present invention are disclosed in U.S. Pat. Nos. 4,532,063; 5,824,339; and 6,175,054; and in United States Patent Publication Nos. 2005/0238697 and 2004/0258733; and in EP 0 692 194, all of which are fully incorporated herein by reference. Several additional polymers can also be included in the water soluble strip. These polymers may or may be water soluble. Such additional polymers include polyethylene (PE), polypropylene (PP), poly (vinyl chloride) (PVC), poly(vinylidene chloride), polystyrene, polyamines (e.g., nylon, etc.), polyesters (e.g., PET, etc.), polyacrylates, spolycarbonate, fluoropolymers (e.g., Teflon, etc.), silicones, natural film formers (e.g., waxes, varnishes, etc.), poly(ethylene oxide) (PEO), poly(acrylic acid) (PAA), and/or polyacrylamide. In one non-limiting formulation of the water soluble films, the water soluble films generally include one or more of the following: poly(vinyl alcohol) [MonoSol], poly(vinyl pyrrolidone) [ISP], cellulose derivatives [Dow Chemical], proteins (e.g., whey, soy, polylysine) [Cargill], starch [Akzo Nobel], and alginates [FMC]. The types of polymers used to for the carrier film will in part be based on the type of actives coated on and/or incorporated into the carrier film. Typically the one or more polymers used in the carrier film will be stable and/or non-reactive to the one or more actives; however, this is not required. The carrier film is generally formed of at least about 30 weight percent water-soluble polymer. In one non-limiting formulation, the carrier film is formed of at least about 40 weight percent water-soluble polymer. In another non-limiting formulation, the carrier film is formed of at a majority weight percent water-soluble polymer. In still another non-limiting formulation, the carrier film is formed of at least about 60 weight percent water-soluble polymer. In yet another non-limiting formulation, the carrier film is formed of at least about 75 weight percent water-soluble polymer. In still yet another non-limiting formulation, the carrier film is formed of at least about 90 weight percent water-soluble polymer. In another non-limiting formulation, the carrier film is formed of at least about 95 weight percent water-soluble polymer. In still another non-limiting formulation, the carrier film is formed of 100 weight percent water-soluble polymer. The carrier film generally constitutes at least about 5 weight percent of the water soluble strip (dry basis). In one non-limiting formulation carrier film constitutes at least about 10 weight percent of the water soluble strip (dry basis). In another non-limiting formulation carrier film constitutes at least about 15 weight percent of the water soluble strip (dry basis). In still another non-limiting formulation carrier film constitutes at least about 20 weight percent of the water soluble strip (dry basis). In yet another non-limiting formulation carrier film constitutes about 25-99.9 weight percent of the water soluble strip (dry basis). In still yet another non-limiting formulation carrier film constitutes about 25-70 weight percent of the water soluble strip (dry basis). In another non-limiting formulation carrier film constitutes about 30-65 weight percent of the water soluble strip (dry basis).

In another non-limiting aspect of the present invention, the polymer type and/or content in the carrier film can be selected to control the rate of release of one or more actives from the water soluble strip; however, this is not required. For example, the release rate of one or more actives from the water soluble strip can be at least partially controlled by 1) the type of polymer (e.g., mixture of water soluble and non-water soluble polymers, mixture of water soluble polymers wherein some alcohol soluble and some are not alcohol soluble, polymers having differing viscosities, etc.), 2) the length, size and/or molecular weight of the polymer, 3) the particle size of one or more actives in the water soluble strip, 4) the concentration of polymer in the water soluble strip, and any combination of these non-limiting factors.

In yet another non-limiting aspect of the present invention, the polymer type and/or content in the carrier film can be selected to control the rate at which the water soluble strip dissolves or degrades in the presence of oxygen and/or water; however, this is not required. In certain application, it may be desirable for the water soluble strip quickly dissolve or degrade in the presence of oxygen and/or water. For example, when the water soluble strip is to be used to form a glass cleaner, a floor cleaner, a carpet spot remover, a pet odor remover, or the like, the user typically wants the formed solution to be make as soon as possible. As such, in such applications, the polymers selected for the water soluble strip are generally selected to cause at least 40 percent the water soluble strip to dissolve or degrade in water in at least about 5 minutes. Additives such as heat forming agents degrading accelerators and the like can be included in the water soluble strip to increase the rate at which the water soluble strip degrades or dissolves in water. In one non-limiting embodiment, the water soluble strip is formulated so as to cause at least 50 percent of the water soluble strip to dissolve or degrade in water in at least about 5 minutes, typically less than about 4 minutes, still more typically less than about 3 minutes, even more typically less than about 2 minutes, and still even ore typically less than about 1.5 minutes. In another non-limiting embodiment, the water soluble strip is formulated so as to cause at least 60 percent of the water soluble strip to dissolve or degrade in water in at least about 5 minutes, typically less than about 4 minutes, still more typically less than about 3 minutes, even more typically less than about 2 minutes, and still even ore typically less than about 1.5 minutes. In still another non-limiting embodiment, the water soluble strip is formulated so as to cause at least 75 percent of the water soluble strip to dissolve or degrade in water in at least about 5 minutes, typically less than about 4 minutes, still more typically less than about 3 minutes, even more typically less than about 2 minutes, and still even ore typically less than about 1.5 minutes. In yet another non-limiting embodiment, the water soluble strip is formulated so as to cause at least 90 percent of the water soluble strip to dissolve or degrade in water in at least about 5 minutes, typically less than about 4 minutes, still more typically less than about 3 minutes, even more typically less than about 2 minutes, and still even ore typically less than about 1.5 minutes. In still yet another non-limiting embodiment, the water soluble strip is formulated so as to cause at least 95 percent of the water soluble strip to dissolve or degrade in water in at least about 5 minutes, typically less than about 4 minutes, still more typically less than about 3 minutes, even more typically less than about 2 minutes, and still even ore typically less than about 1.5 minutes. Rapid dissolving of the water soluble strip may also be desirable for applications such as toilet bowl cleaning strips, drain cleaning and unclogging strips and the like. On the other hand, for applications such as dishwasher strips, washing machine strips, laundry spot cleaning strips and the like, it may be desirable for the water soluble strip to dissolve or degrade at a slower rate; however, this is not required.

In still another non-limiting aspect of the present invention, the water soluble strip typically includes a heat forming agent. The heat forming agent is formulated to generate heat in the presence of water and/or oxygen (e.g., oxygen in the air, etc.) and to thereby accelerate the rate at which the water soluble strip degrades in the presence of water and/or oxygen, and/or to increase the effectiveness of one or more of the actives in the water soluble strip. The heat forming agent can also or alternatively be used to accelerate the rate of release of one or more actives from the water soluble strip; however, this is not required. The heat forming agent is formulated to undergo an exothermic reaction when exposed to oxygen (i.e., oxygen in the air, oxygen in the water, etc.) and/or water. Many different materials and combination of materials can be used as the heat forming agent. Non-limiting heat forming agents that can be used in the water soluble strip of the present invention include electrolyte salts (e.g., aluminum chloride, calcium chloride, calcium sulfate, cupric chloride, cuprous chloride, ferric sulfate, magnesium chloride, magnesium sulfate, manganese chloride, manganese sulfate, potassium chloride, potassium sulfate, sodium acetate, sodium chloride, sodium carbonate, sodium sulfate, etc.), glycols (e.g., propylene glycol, dipropylenenglycol, etc.), lime (e.g., quick lime, slaked lime, etc.), metals (e.g., chromium, copper, iron, magnesium, manganese, etc.), metal oxides (e.g., aluminum oxide, iron oxide, etc.), polyalkyleneamine, polyalkyleneimine, polyvinyl amine, zeolites, gycerin, 1,3, propanediol, polysorbates esters (e.g., Tweens 20, 60, 85, 80), and/or poly glycerol esters (e.g., Noobe, Drewpol and Drewmulze from Stepan). The heat forming agent can be formed of one or more materials. For example, magnesium sulfate can singularly form the heat forming agent. In another non-limiting example, the combination of about 2-25 weight percent activated carbon, about 30-70 weight percent iron powder and about 1-10 weight percent metal salt can form the heat forming agent. As can be appreciated, other or additional materials can be used alone or in combination with other materials to form the heat forming agent. Non-limiting examples of materials that can be used to form the heat forming agent used in the water soluble strip of the present invention are disclosed in U.S. Pat. Nos. 5,674,270 and 6,020,040; and in United States Patent Publication No. 2008/0132438, all of which are incorporated herein by reference.

In yet another non-limiting aspect of the present invention, the heat forming agent can be partially or fully encapsulated in a protective coating; however, this is not required. The protective coating, when used, is generally used to 1) limit contact between one or more actives and the heat forming agent so as to inhibit or prevent a premature exothermic reaction of the heat forming agent and/or to inhibit or prevent an undesired or premature reaction between the heat forming agent and the one or more actives prior to the dissolving or degrading of the water soluble strip, 2) limit contact between the one or more polymers of the carrier film and the heat forming agent so as to inhibit or prevent a premature exothermic reaction of the heat forming agent and/or to inhibit or prevent an undesired or premature reaction between the heat forming agent and the one or more polymers of the carrier film prior to the dissolving or degrading of the water soluble strip, 3) limit contact between other components in the water soluble strip and the heat forming agent so as to inhibit or prevent a premature exothermic reaction of the heat forming agent and/or to inhibit or prevent an undesired or premature reaction between the heat forming agent and the one or more other components of the water soluble strip prior to the dissolving or degrading of the water soluble strip, and/or 4) limit contact of the heat forming agent with oxygen and/or water prior to the dissolving or degrading of the water soluble strip. The protective coating, when used, can be formed of a variety of materials (e.g., wax, polymers, etc.). The heat forming agent can be uniformly dispersed in the water soluble strip, uniformly coated on the outer surface of the water soluble strip and/or be positioned in controlled regions on/in the water soluble strip. The heat forming agent content (including any protective coating) in the water soluble strip is at least about 2 weight percent. In one non-limiting formulation of the water soluble strip, the heat forming agent content (including any protective coating) in the water soluble strip is at least about 5 weight percent. In another non-limiting formulation of the water soluble strip, the heat forming agent content (including any protective coating) in the water soluble strip is at least about 10 weight percent. In still another non-limiting formulation of the water soluble strip, the heat forming agent content (including any protective coating) in the water soluble strip is about 10-45 weight percent. In yet another non-limiting formulation of the water soluble strip, the heat forming agent content (including any protective coating) in the water soluble strip is about 12-30 weight percent. In still another non-limiting formulation of the water soluble strip, the heat forming agent content (including any protective coating) in the water soluble strip is about 14-25 weight percent.

In still yet another non-limiting aspect of the present invention, the type of heat forming agent and/or concentration of heat forming agent on/in the water soluble strip can be selected to generate a certain amount of heat as the water soluble strip degrades and/or dissolves; however, this is not required. In one non-limiting embodiment of the invention, the heat forming agent heats to a maximum temperature of at least about 85° F. In another non-limiting embodiment of the invention, the heat forming agent heats the diluted cleaning product, formed by the water soluble strip in water, to a maximum temperature of about 90-180° F. In still another non-limiting embodiment of the invention, the heat forming agent heats diluted cleaning product, formed by the water soluble strip in water, to a maximum temperature of about 95-130° F. As can be appreciated, the type and/or concentration of the heat forming agent can be selected to generate higher maximum temperatures. In yet another non-limiting embodiment of the invention, the heat forming agent generates heat to result in a change in temperature of the region immediately surrounding the water soluble strip of about 2-50° F., typically about 2-30° F., and ore typically about 3-23° F. For example, when Tweens® are used as the heat forming agent, a five (5) weight percent concentration in the water soluble strip can result in a temperature increase of about 2° F.±1° F., a twenty (20) weight percent concentration in the water soluble strip can result in a temperature increase of about 10° F.±4° F., and a fifty (50) weight percent concentration in the water soluble strip can result in a temperature increase of about 15° F.+5° F.

In another non-limiting aspect of the present invention, the water soluble strip includes a removable protective covering that is used to limit or prevent exposure of the heat forming agent in the soluble film to water and/or oxygen until the protective covering is at least partially removed from the water soluble strip. As can be appreciated, the protective coating can also or alternatively be used to limit or prevent exposure of one or more other components (e.g., actives, foaming agents, carrier film, etc.) of the water soluble strip to water and/or oxygen; however, this is not required. The removable protective covering can be used to control the activation of the heat forming agent in the water soluble strip, and/or one or more other components in the water soluble strip. In one non-limiting embodiment of the invention, the removable protective is a removable strip (e.g., plastic strip, etc.) that is removable from a portion of the water soluble strip. In this arrangement, the removable strip partially or fully covers and/or overlies the portion of the water soluble strip that includes the agent that is to be partially or fully protected from oxygen and/or water (e.g., heat forming agent, actives, foaming agent, carrier film, etc.). As such, when the removable strip is partially or fully removed from the region of the water soluble strip that includes heat forming agent, the heat forming agent begins to react with the oxygen in the air and thereby generates heat. Alternatively or additionally, after the removable strip is removed from the region of the water soluble strip that includes heat forming agent and the water soluble strip is exposed to water, the water contacts the heating forming agent thereby resulting in heat generation by the heat forming agent. A non-limiting example of a removable strip that can be used with the water soluble strip of the present invention is disclosed in U.S. Pat. No. 5,674,270, which is fully incorporated herein by reference. In another non-limiting embodiment of the invention, the water soluble strip is packaged in an protective packet or sleeve. In this arrangement, the packet or sleeve partially or fully encapsulates the water soluble strip. As such, when the packet or sleeve is opened and the water soluble strip is removable strip is removed from the packet or sleeve, one or more components in the water soluble strip (e.g., the heat forming agent, actives, carrier film, foaming agents, etc.) can begin to react with the oxygen in the air. Alternatively or additionally, after the water soluble strip is removed from the packet or sleeve and the water soluble strip is exposed to water, the water contacts one or more components in the water soluble strip (e.g., the heat forming agent, actives, carrier film, foaming agents, etc.) to begin a reaction with one or more components. For example, when the water soluble strip includes heat forming agent, the contact of the water with the heat forming agent can cause the heat forming agent to generate heat.

In still another non-limiting aspect of the present invention, the content of the heat forming agent in the water soluble strip is sufficient to generate heat for at least about 20 seconds after the water soluble strip is exposed to oxygen and/or water, and/or after a protective covering is at least partially removed to at least partially expose the heat forming agent to oxygen and/or water. In certain applications such as stain removal from clothing, drain cleaning, etc., the use of heat generation by the heat forming agent can improve the stain cleaning, drain unclogging, etc. function of the water soluble strip. In one non-limiting formulation of the water soluble strip, the content of the heat forming agent in the water soluble film is sufficient to generate heat for at least about 30 seconds after the water soluble strip is exposed to oxygen and/or water, and/or after a protective covering is at least partially removed to at least partially expose the heat forming agent to oxygen and/or water. In another non-limiting formulation of the water soluble strip, the content of the heat forming agent in the water soluble film is sufficient to generate heat for at least about 60 seconds after the water soluble strip is exposed to oxygen and/or water, and/or after a protective covering is at least partially removed to at least partially expose the heat forming agent to oxygen and/or water. In still another non-limiting formulation of the water soluble strip, the content of the heat forming agent in the water soluble film is sufficient to generate heat for about 1-30 minutes after the water soluble strip is exposed to oxygen and/or water, and/or after a protective covering is at least partially removed to at least partially expose the heat forming agent to oxygen and/or water. In yet another non-limiting formulation of the water soluble strip, the content of the heat forming agent in the water soluble film is sufficient to generate heat for about 1.5-10 minutes after the water soluble strip is exposed to oxygen and/or water, and/or after a protective covering is at least partially removed to at least partially expose the heat forming agent to oxygen and/or water. As can be appreciated, the water soluble strip can be formulated so that heat generation continues to occur for longer time periods.

In yet another non-limiting aspect of the present invention, the water soluble strip can include degrading accelerator used to accelerate the rate at which the water soluble strip degrades in the presence of water and/or oxygen. The inclusion of a degrading accelerator in the water soluble strip is optional. The degrading accelerator, when used, is generally designed to release gas when exposed to water and/or oxygen, which in turn agitates the region about the water soluble strip so as to cause acceleration in the degradation of the carrier film of the water soluble strip. The degrading accelerator, when used, can also or alternatively be used to accelerate the rate of release of one or more actives from the water soluble strip; however, this is not required. The degrading accelerator, when used, can also or alternatively be used to increase the effectivity of one or more of the actives in the water soluble strip; however, this is not required. The degrading accelerator can include one or more materials such as, but not limited to, alkali metal carbonates (e.g. sodium carbonate, potassium carbonate, etc.), alkali metal hydrogen carbonates (e.g., sodium hydrogen carbonate, potassium hydrogen carbonate, etc.), ammonium carbonate, etc. The water soluble strip can optionally include one or more activators that are used to activate or increase the rate of activation of the one or more degrading accelerators in the water soluble strip. The use of activators in the water soluble strip is optional. As can be appreciated, one or more activators can be included in the water soluble strip even when no degrading accelerator exists in the water soluble strip; however, this is not required. For instance, the activator can include an acidic or basic compound, wherein such acidic or basic compound can be used as a supplement to one or more actives in the water soluble strip when a degrading accelerator is or is not included in the water soluble strip. Non-limiting examples of activators, when used, that can be included in the water soluble strip include organic acids (e.g., hydroxy-carboxylic acids [citric acid, tartaric acid, malic acid, lactic acid, gluconic acid, etc.], saturated aliphatic carboxylic acids [acetic acid, succinic acid, etc.], unsaturated aliphatic carboxylic acids [e.g., fumaric acid, etc.). The degrading accelerator, when used in the water soluble strip, generally constitutes at least about 0.01 weight percent of the water soluble strip. In one non-limiting formulation, the degrading accelerator, when used in the water soluble strip, generally constitutes at least about 0.1 weight percent of the water soluble strip. In another non-limiting formulation, the degrading accelerator, when used in the water soluble strip, generally constitutes at least about 0.5 weight percent of the water soluble strip. In still another non-limiting formulation, the degrading accelerator, when used in the water soluble strip, generally constitutes up to about 20 weight percent of the water soluble strip. In yet another non-limiting formulation, the degrading accelerator, when used in the water soluble strip, generally constitutes about 1-15 weight percent of the water soluble strip. In still yet another non-limiting formulation, the degrading accelerator, when used in the water soluble strip, generally constitutes about 2-10 weight percent of the water soluble strip. The activator, when used in the water soluble strip, generally constitutes at least about 0.01 weight percent of the water soluble strip. In one non-limiting formulation, the activator, when used in the water soluble strip, generally constitutes at least about 0.1 weight percent of the water soluble strip. In another non-limiting formulation, the activator, when used in the water soluble strip, generally constitutes at least about 0.5 weight percent of the water soluble strip. In still another non-limiting formulation, the activator, when used in the water soluble strip, generally constitutes up to about 25 weight percent of the water soluble strip. In yet another non-limiting formulation, the activator, when used in the water soluble strip, generally constitutes about 1-20 weight percent of the water soluble strip. In still yet another non-limiting formulation, the activator, when used in the water soluble strip, generally constitutes about 2-15 weight percent of the water soluble strip. In another non-limiting formulation, the weight ratio of the activator to the degrading accelerator, when both included in the water soluble strip, is about 0.2-3:1. In still another non-limiting formulation, the weight ratio of the activator to the degrading accelerator, when both included in the water soluble strip, is about 0.5-2:1. In still another non-limiting formulation, the weight ratio of the activator to the degrading accelerator, when both included in the water soluble strip, is about 0.75-1.8:1.

In still yet another non-limiting aspect of the present invention, the water soluble strip includes one or more actives. Non-limiting examples of actives that can be included in the water soluble strip include, acid agent, bleaching agent, enzymes, surfactant and detergent, sequestrant, pH adjuster, antimicrobial agent, and the like. One or more actives can be included in the water soluble strip. As can be appreciated, one or more actives in the water soluble strip can have more one than one function. For example, peroxides and sodium hypochlorite can function both as a bleaching agent and as an antimicrobial agent. The weight percent of the one or more actives in the water soluble strip is generally at least about 5 weight percent and generally no more than about 80 weight percent of the water soluble strip. In one non-limiting formulation, the weight percent of the one or more actives in the water soluble strip is about 10-75 weight percent. In another non-limiting formulation, the weight percent of the one or more actives in the water soluble strip is about 15-70 weight percent. Non-limiting examples of actives that can be used in the water soluble strip of the present invention are disclosed in United States Patent Publication Nos. 2006/0009369 and 2008/0132438, which are fully incorporated herein by reference.

Non-limiting examples of bleaching agent that can be included in the water soluble strip of the present invention include hypochlorite (calcium hypochlorite, etc.), peroxide, hydroxide (e.g., calcium, hydroxide, sodium hydroxide, etc.), chloramines, chlorimines, chloramides, chlorimides, and the like. Several more specific non-limiting examples of bleaching agents that can be included in the water soluble strip include potassium hypochlorite, lithium hypochlorite, calcium hypochlorite, calcium hypochlorite dihydrate, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, 1,3-dichloro-5,5-dimethylhydantoin, N-chlorosulfamide, Chloramine T, Dichloramine T, Chloramine B, Dichloramine B, and Di-Halo (bromochlorodimethyl hydantoin), N-chlorosuccinimide, N-chloromalonimide, N-chlorophthalimide, and [mono-(trichloro)-tetra-(mono-potassium dichloro)]pentaisocyanurate, 1,3-dichloro-5,5-dimethylhydantoin, N-monochloro-5,5-dimethylhydantoin, methylene-bis(N-chloro-5,5-dimethylhydantoin), 1,3-dichloro-5-methyl-5-isobutylhydantoin, 1,3-dichloro-5-methyl 5-ethylhydantoin. 1,3-dichloro-5,5-diisobutylhydantoin, and 1,3-dichloro-5-methyl-5-n-amylhydantoin, trichloromelamine, N-chloromelamine, monochloramine, dichloramine, paratoluene sulfondichloroamide, N,N-dichloroazodicarbonamide, N-chloroacetyl urea, N,N-dichloro-biuret, chlorinated dicyandiamide, dichloroglycoluril, N,N-dichlorobenzoylene urea, and N,N-dichloro-p-toluenesulfonamide, sodium dichloroisocyanurate, sodium dichloroisocyanurate dihydrate, potassium dichloroisocyanurate, potassium dichloroisocyanurate dihydrate, sodium dichloroisocyanurate dihydrate, sodium dichloroisocyanurate, potassium dichloroisocyanurate dihydrate, potassium dichloro-isocyanurate, sodium perborate monohydrate, sodium perborate tetrahydrate, and/or sodium percarbonate. One or more bleaching agents can be included in the water soluble strip.

Non-limiting examples of antimicrobial agent that can be included in the water soluble strip include isothiazolones, alkyl dimethyl ammonium chloride, triazines, 2-thiocyanomethylthio benzothiazol, methylene bis thiocyanate, acrolein, dodecylguanidine hydrochloride, chlorophenols, quarternary ammonium salts, gluteraldehyde, dithiocarbamates, 2-mercaptobenzothiazole, para-chloro-meta-xylenol, silver, chlorohexidine, polyhexamethylene biguanide, n-halamines, triclosan, phospholipids, alpha hydroxyl acids, 2,2-dibromo-3-nitrilopropionamide, 2-bromo-2-nitro-1,3-propanediol, farnesol, iodine, bromine, biguanide compounds, chlorine dioxide, alcohols, ozone, botanical oils (e.g., tee tree oil and rosemary oil), botanical extracts, benzalkonium chloride, chlorine, sodium hypochlorite, peroxide, alcohols, peroxides, boric acid and borates, chlorinated hydrocarbons, organometallics, halogen-releasing compounds, mercury compounds, metallic salts, pine oil, essential oils, organic sulfur compounds, iodine compounds, silver nitrate and other silver compounds, quaternary phosphate compounds, and/or phenolics. One or more antimicrobial agents can be included in the water soluble strip.

Non-limiting examples of surfactant that can be included in the water soluble strip include nonionic, semi-polar, anionic, cationic, zwitterionic, and/or amphoteric surfactants. Many of these surfactants are described in *McCutcheon's Emulsifiers and Detergents* (1997), *Kirk-Othmer, Encyclopedia of Chemical Technology,* 3rd Ed., Volume 22, pp. 332-432 (Marcel-Dekker, 1983), and *McCutcheon's Soaps and Detergents* (N. Amer. 1984), the contents of which are hereby incorporated by reference. Typically the surfactant is partially or fully soluble in water. In one embodiment, the surfactant includes, but is not limited to, glycoside, glycols, ethylene oxide and mixed ethylene oxide/propylene oxide adducts of alkylphenols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, cocoamphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl polyether alcohols, salts of higher alkyl substituted imadazolinium dicarboxylic acids, ferchorics, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and/or imidazolines. In one aspect of this embodiment, the surfactant includes, but is not limited to, lauryl sulfate, laurylether sulfate, cocamidopropylbetaine, alkyl polyglycosides, amine oxides, ethoxylated alkylphenols, polyethylene glycol ethers, water soluble alcohol ethylene oxide condensates, alkyl polyglycosides, alkyl di(lower alkyl)amine oxides, alkyl di(hydroxy lower alkyl)amine oxides, alkylmorpholine oxides, alkyl sulfates, alkyl ether sulfates, alkyl ether sulfonates, alpha-olefin sulfonates, beta-alkoxy alkane sulfonates, alkylauryl sulfonates, alkyl monoglyceride sulfates, alkyl monoglyceride sulfonates, alkyl carbonates, alkyl ether carboxylates, sulfosuccinates, sarcosinates, taurates, lauryl sulfates, octyl sulfates, 2-ethylhexyl sulfates, lauramine oxide, decyl sulfates, tridecyl sulfates, cocoates, lauroyl sarcosinates, lauryl sulfosuccinates, oleates, stearates, tallates, ricinoleates, cetyl sulfates, cetylpyridinium chloride, methylbenzethonium chloride, lecithin, lecithin derivatives, glycerol esters, sorbitan derivatives, glycerol lactoesters of fatty acids, ethoxylated fatty esters, and the like. One or more surfactants can be included in the water soluble strip.

Non-limiting examples of pH adjusters that can be included in the water soluble strip include: ammonia, alkyl amines, alkanolamines, alkali metal hydroxides, alkaline earth metal hydroxides, alkali metal silicates, alkaline earth metal silicates, mineral acids, carboxylic acids, polymeric acids. One or more pH adjusters can be included in the water soluble strip.

Non-limiting examples of sequestrant that can be included in the water soluble strip include: ethylenediamines, ethylenediaminetetraacetic acids, citric acids, glucuronic acids, polyphosphates, organophosphates, dimercaprols, and the like. One or more sequestrants can be included in the water soluble strip.

Non-limiting examples of enzymes that can be included in the water soluble strip include lipases, proteases, amylases, cellulases, and/or peroxidases, and/or hydrotropes such as xylene sulfonates and/or toluene sulfonates. One or more enzymes can be included in the water soluble strip.

Non-limiting examples of acid agent that can be included in the water soluble strip include organic hydroxy acids, citric acids, keto acid, and the like.

In another non-limiting aspect of the present invention, the water soluble strip can include one or more additives; however, this is not required. Such additives include, but are not limited to, thermochromic agent, dye, pigment, plasticiser, defoamers, thickeners, anti-dye transfer agents, fragrance, preservative, solvent, opacifiers, clarifiers, humectant, and the like. The water soluble strip can include one or more additives. The one or more additives, when used, constitute at least about 0.01 weight percent of the water soluble strip. Generally, one or more additives, when used, constitute up to about 35 weight percent of the water soluble strip. Non-limiting examples of additives that can be used in the water soluble strip of the present invention are disclosed in U.S. Pat. No. 6,175,054 and United States Publication Patent Nos. 2006/0009369 and 2008/0132438, which are fully incorporated herein by reference.

Thermochromic agent and/or dye, when included in the water soluble strip, can be used to provide visual information to a user. For instance, a thermochromic agent and/or dye can be used to change the color of the water when forming a hard surface cleaner. The color change of the water can be used to inform the user that the water soluble strip is dissolving and/or degrading in the water and/or that the formed solution is ready to use. Also or alternatively, a thermochromic agent can be used to indicate that the water soluble strip is heating and/or cleaning. Such information may be useful for products such as drain cleaners, toilet bowl cleaners and the like.

The water soluble strip can include preservative to increase the shelf life of the water soluble strip; however, this is not required. Non-limiting examples of preservative that can be used in the water soluble strip include, but are not limited to, benzoic acid, benzoic esters, diazolidinyl urea, imidazolidinyl urea, iodopropynyl butylcarbonate, methylisothiazolinone, methylchloroisothiazolinone, tetrasodium EDTA, and the like.

The water soluble strip can include solvent such as water and/or non-aqueous solvents; however, this is not required. The solvent, when used, can be used to aid in dissolving one or more other components of the water soluble strip (e.g., actives, preservatives, biocide, etc.). Non-limiting examples of solvent include, but are not limited to, water, acetone, alcohol (e.g., ethanol, propanol, etc.), ethyl acetate, glycerine, glycol, triacetin, triglycerides, and the like.

The water soluble strip can include humectant to control the moisture content of the water soluble strip; however, this is not required. The humectant, when used, can include, but is not limited to, glycerin, polyethylene glycol, propylene glycol, hydrogenated starch hydrolysates, sorbitol, mannitol, and the like.

The water soluble strip can include a plasticizer to alter the flexibility of the water soluble strip; however, this is not required. The plasticizer, when used, can include, but is not limited to, propylene glycol, glycerol, d-panthanol, sodium lactate, polyethylene glycol, sorbitol, glycerol esters, partially hydrogenated rosin, and the like. The type of plasticizers used in the water soluble strip will generally depend on the application of the water soluble strip and the type of polymer used to form the carrier film.

Non-limiting examples of thickeners that can be included in the water soluble strip include polyacrylic acid, xanthan gum, calcium carbonate, aluminum oxide, alginates, guar gum, methyl, ethyl, clays, and/or propylhydroxycelluloses.

Non-limiting defoamers that can be included in the water soluble strip include silicones, aminosilicones, silicone blends, and/or silicone/hydrocarbon blends.

The anti-dye transfer agent, when used, is formulated to provide anti-dye transfer and color protection properties to the improved cleaning composition without adversely affecting stain or soil removal properties and/or soil redeposition properties of the improved cleaning composition. Non-limiting examples of anti-dye transfer agent that can be included in the water soluble strip includes polyvinylpyrrolidone; quaternary polyvinylpyrridinium derivatives; polyvinylimidazole; polyvinylpyridine oxide; copolymers of polyvinylpyridine and polyvinylimidazole; vinyl imidazole homo- or copolymer; polyamine oxide; vinylimidazole; vinylpyrrolidone; vinyl pyridine; dimethylaminoethyl methacrylate; dimethylamino-propylmethacrylamide; poly(4-vinylpyridine-N-oxide); copolymers of vinylpyrrolidone and vinylimidazole; copolymers of polyvinylpyrrolidone and vinylimidazole; copolymers of vinylpyrrolidone and polyvinylimidazole; copolymers vinylimidazole, vinyloxazolidone and/or -vinylpyrrolidone; polymeric compounds based on -vinylpyrrolidone and/or -vinylimidazole and/or -vinyloxazolidone; vinyloxazolidone; and/or poly(vinylpyridine betaines).

In still another non-limiting aspect of the present invention, the water soluble strip can include one or more perforations and/or markings to provide a visual indicator to a user of a desired amount of strip to be used. For example, then the strip is provided in a roll of strip that is continuously dispensed from a dispenser, the perforations and/or markings on the strip inform a user the amount of strip for a particular application. As can be appreciated, some applications will require more strip length than other application, thus the perforations and/or markings enable a user to select the required or desired length of strip for a particular application. As can be appreciated, the water soluble strip can be precut in certain lengths and dispensed from a dispenser at such precut lengths. When the strip is offered in a roll of strip and includes perforations, the perforations can be used to facilitate is tearing off a certain length of strip; however, this is not required.

In yet another non-limiting aspect of the present invention, each of the water soluble strips can be individually packaged or two or more strips can be individually packaged. Each package of strip can be designed for a single use or application. The packaging can be water and/or air proof packaging to protect the strip from expose to oxygen and/or water; however, this is not required.

In still yet another non-limiting aspect of the present invention, one or more actives in the water soluble strip can be partially or fully encapsulated in a protective coating. The protective coating can be formed by one or more polymers that form of the carrier film and/or formed by some other material. The partial or complete encapsulation of one or more actives is designed to 1) inhibit or prevent premature reaction with oxygen and/or water, 2) inhibit or prevent premature reaction of one or more actives with one or more other actives or components that are coated on and/or incorporated in the carrier film, 3) inhibit or prevent premature reaction of one or more actives with the one or more polymers used to form the carrier film, 4) limit the amount of skin contact with one or more actives in the water soluble strip, and/or 5) inhibit or prevent one or more actives prematurely reacting with one or more other components of the water soluble strip. The partial or fully encapsulation of one or more actives can take the form of a) a coating that partially or fully coats the outer surface of one or more actives, b) a film wherein one or more actives are partially or fully embedded in the film, and/or c) one or more compartments or chambers formed in the water soluble strip that contains one or more actives. As can be appreciated, other or additional arrangements can be used to partially or fully encapsulate one or more of the actives used on the water soluble strip. When one or more compartments are formed in the water soluble strip, the one or more compartments can constitute from 1-99.5% of the volume of the water soluble strip. Also, when two or more compartments are formed in the water soluble strip, the compartments can contain the same or different type, concentration and/or amount of active. As can be appreciated, the same or different polymer(s) used to form the carrier film can be used to partially or fully encapsulate one or more of the actives used on the water soluble strip. When one or more actives are to be partially or fully encapsulated, the partial or full encapsulation can take place before, during or after the one or more actives are incorporated with the carrier film. As can be appreciated, the water soluble strip can include one or more partially or fully encapsulated actives and one or more actives that are not partially or fully encapsulated. As can also be appreciated, one or more actives can be incorporated with the carrier film at different times during the formation of the water soluble strip.

In another non-limiting aspect of the present invention, the water soluble strip is formulated to not be digested or ingested by a human or be used a topical application to the skin of a human. In one embodiment of the invention, the water soluble strips contain one or more active ingredients which is not suitable or which are at a concentration that is not suitable for digestion or ingestion. In one non-limiting example, the water soluble strips may contain: bleaching agents and/or disinfecting agents such as hypochlorite, peroxides, quaternary ammonium compounds, essential oils, etc. which are at a concentration that makes them unsuitable for ingestion or extended skin contact times (i.e. greater time than required to handle and apply the strip for a cleaning or laundry application). In one embodiment of the invention, the water soluble strips contain one or more active ingredients which is not suitable for extended skin contact times of greater than 30 seconds, greater than 1 minute, greater than 2 minutes or greater than 5 minutes. In one embodiment of the invention, the water soluble strips and the one or more actives used in the water soluble strip are formulated for hard surface cleaning purposes. In another embodiment of the invention, the water soluble strips and the one or more actives used in the water soluble strip are formulated for laundry or textile pre-treatment and/or cleaning applications. Such water soluble strips are thus distinguishable from water soluble strips that are placed in a mouth of human and applied to dissolve in the mouth or be digested in the stomach of a human such as breathe freshener strip, medicine strips, and the like. The water soluble strips that are used for cleaning and the like include active concentrations and types that are used for sanitizing and/or disinfecting purposes. Such, water soluble strips are non-digestible, not for topical use on a human, and not for use a medical healing strip.

It is a non-limiting object of the present invention to provide a strip of material that includes one or more actives and which strip at least partially dissolves in a diluent to for a cleaning system.

It is another and/or alternative non-limiting object of the invention to provide a water soluble strip that includes one or more actives, which strip is formulated to at least partially dissolve in water to form a cleaning solution.

It is still another and/or alternative non-limiting object of the invention to provide a water soluble strip that includes one or more heat forming agents that are used to increase the rate at which the water soluble strip at least partially dissolves in water and/or facilitates in the cleaning effectiveness of one or more actives in the water soluble strip.

It is yet another and/or alternative non-limiting object of the invention to provide a water soluble strip that reduces or eliminates the need to maintain various containers of cleaning solutions for various types of cleaning purposes.

It is still yet another and/or alternative non-limiting object of the invention to provide a water soluble strip that increases the ease of cleaning.

It another and/or alternative non-limiting object of the invention to provide a water soluble strip that is simple to use and easy and convenient to store in a household.

These and other objects and advantages will become apparent to those skilled in the art upon reading and following the description of the invention taken together with the accompanied drawing.

BRIEF DESCRIPTION OF THE DRAWING

Reference may now be made to the drawing, which illustrates various attributes of the invention wherein;

FIG. 1 is a graphical illustration of a temperature increase of the dissolving water soluble film based on the concentration of Tween in the water soluble film.

DETAILED DESCRIPTION OF NON-LIMITING EMBODIMENTS

Referring now to the below description that is use for purposes of describing non-limiting embodiments of the invention only and not for the purpose of limiting same, the present invention is directed to a water soluble strip that includes one or more actives. The water soluble strip generally includes a concentrated amount of actives so that when the water soluble strip is dissolved in water, the active content is sufficient to perform the desired cleaning function. The active and additive content of the water soluble strip is selected to form a water soluble strip that can be used in certain types of cleaning operations. For example, the water soluble strip can be formulated to clean hard surfaces (e.g., countertops, floors, appliances, etc.), clean glass surfaces, clean carpets, remove pet odors, clean dishes, clean laundry, clean tile, clean toilets, clean furniture, unclog drains, etc. This uses of the water soluble strip are not to be associated with strips ingested by humans or topically applied to the skin of a human. The water soluble strips associated with the uses set forth above are for cleaning, deodorizing, disinfecting and/or sanitizing various non-living surfaces, clothing, and/or drains. Indeed, the water soluble strip can be used as a partial or complete substitute for many different types of liquid, aerosol and granular cleaners. The use of water soluble strips as a substitute for common household cleaners has many advantages over such cleaners such as 1) the water soluble strips are smaller, lighter in weight and easier to use and store as compared with most common household cleaners, 2) water soluble strips are pre-sized and concentrated so as to eliminate measuring errors that can commonly occur when using common household cleaners common household cleaners, and 3) less messy to use in certain types of application (e.g., dishwashing, laundry cleaner, toilet bowl cleaning, etc.) as compared to using liquid, spray or granular cleaners. As can be appreciated, the type cleaning applications that can use the water soluble strip is numerous and not limited to the above abbreviated list of applications.

The size, thickness and shape of the water soluble strip is non-limiting. For example, the length of the water soluble strip is generally about 2-20 cm, typically about 5-15 cm, and more typically about 7-12 cm. The width of the water soluble strip is generally about 1-10 cm, typically about 2-8 cm, and more typically about 3-6 cm. The thickness of the water soluble strip is generally about 1-20 mills, typically about 2-15 mills, and more typically about 3-10 mills. The shape of the water soluble film is typically square or rectangular; however, other shapes can be used (e.g., circular, oval, triangular, etc.). The water soluble strip is typically a flexible strip; however, this is not required. The color of the water soluble strip is non-limiting. The water soluble strip can be clear, cloudy, colored, etc. The water soluble strip is generally a light weight strip having a weight that is generally less than about 200 g, and typically less than 100 g.

The water soluble strip is generally formulated so that one or two strips can be used perform the desired cleaning function or form the desired cleaning solution. In one non-limiting example, a water soluble strip that is designed for use in a dishwasher can be formulated such that one or two strips merely are required to be placed and in the dishwasher to properly clean the dishes during a washing cycle. The use of such a water soluble strip eliminates the need to measure and used the needed amount of dishwashing detergent to properly clean the dishes. In another non-limiting example, when the water soluble strip is for use a glass cleaner, the strip is formulate such that a single strip is placed in a quart container and filled with water. Once the water soluble strip dissolves or degrades, a glass cleaning solution is formed for proper cleaning of glass surfaces. Several non-limiting examples of water soluble strip in accordance with the present invention as set forth below.

Floor Cleaning Strip

The water soluble strip can be formulated to form a cleaning solution for use in the cleaning of floors. Common liquid cleaners such as Pine-Sol™, Mr. Clean™ and the like are used to clean floors and other types of hard surfaces. These liquid cleaners are commonly poured into a bucket or other type of contain and water is added to dilute the liquid cleaner. Although the liquid cleaner generally include information about the desired amount of cleaner to be used in a certain amount of water, users may not read or properly follow the instructions, thereby resulting in a weaker cleaning solution than desired to clean a hard surface. Furthermore, the pouring of liquid cleaners into a bucket can be messy. Also, the pouring of liquid cleaners from large, bulky and/or heavy containers can be difficult for some users. The use of the water soluble strip of the present invention overcomes many or all of these deficiencies. The water soluble strip is pre-formulated for use in a certain amount of water, thus measuring of the cleaner is eliminated. As can be appreciated, more than one strip can be used for difficult to clean jobs and/or when larger containers are to be used to form the cleaning solution. The water soluble strip is a solid, small and light weigh strip that is easy to handle and use. The water soluble strip is also much easier to handle and more convenient to store due to the small size and light weight of the strip. In some instances, the shelf life of the water soluble strip may be longer than certain types of spray or liquid cleaners.

The types and amount of actives in the water soluble strip is non-limiting. As such, many different types of cleaning solutions can be formed by the water soluble strip of the present invention. Non-limiting examples of one type of floor cleaning water soluble strip is set forth below.

| Component | Example 1 | Example 2 | Example 3 |
|---|---|---|---|
| Actives | 1-50 wt. % | 2-30 wt. % | 3-20 wt. % |
| Additives | 0-40 wt. % | 0-30 wt. % | 0-25 wt. % |
| Solvents | 0-80 wt. % | 5-75 wt. % | 20-75 wt. % |
| Carrier film | 5-60 wt. % | 5-50 wt. % | 10-40 wt. % |

| Component | Example 4 | Example 5 | Example 6 |
|---|---|---|---|
| Actives (other than heat forming agent and degrading accelerator) | 3-15 wt. % | 5-15 wt. % | 5-10 wt. % |
| Heat Forming Agent | 0.5-25 wt. % | 1-20 wt. % | 5-15 wt. % |
| Degrading Accelerator | 0-20 wt. % | 0-15 wt. % | 0.5-12 wt. % |
| Alcohol | 0-20 wt. % | 1-18 wt. % | 3-15 wt. % |
| Water | 0-70 wt. % | 10-70 wt. % | 30-65 wt. % |
| Coloring Agent | 0-5 wt. % | 0.01-3 wt. % | 0.1-1 wt. % |
| Fragrance | 0-4 wt. % | 0-3 wt. % | 0-3 wt. % |
| Carrier film | 10-40 wt. % | 15-35 wt. % | 18-30 wt. % |

The type of active used in the above formulations is non-limiting. One example of an active that can be used is pine oil. The active can also or alternatively include one or more surfactant or detergent agents, acids (e.g., citric acid) and/or many other types of cleaning agents. Three specific types of pine oil based water soluble strips are set forth as follows:

| Component | Example 7 | Example 8 | Example 9 |
|---|---|---|---|
| Pine oil | 10-13 wt. % | 8.5-9.5 wt. % | 5.9-6.3 wt. % |
| HLAS | 1.7-2.1 wt. % | 1.7-2.1 wt. % | 0 wt. % |
| IPA | 4.4-5 wt. % | 2.9-3.2 wt. % | 1.1-1.3 wt. % |
| Surfonic L12-8 ™ | 2.7-3.1 wt. % | 2.5-2.7 wt. % | 0 wt. % |
| Water | 30-40 wt. % | 35-45 wt. % | 45.5-50 wt. % |
| Bio-terge ™ | 1.6-2 wt. % | 1.6-2 wt. % | 0 wt. % |
| Ammonium hydroxide | 0.02-0.04 wt. % | 0.02-0.04 wt. % | 0 wt. % |
| Sodium Hydroxide | 0.15-0.3 wt. % | 0.15-0.3 wt. % | 0 wt. % |
| Benzoic Acid | 0.2-0.3 wt. % | 0.2-0.3 wt. % | 0 wt. % |
| Hydroxyacetic acid | 0.2-0.3 wt. % | 0.2-0.3 wt. % | 0 wt. % |
| Steol CS460 | 0.3-0.5 wt. % | 0.3-0.5 wt. % | 0 wt. % |
| Ethoxy Alcohol | 0 wt. % | 0 wt. % | 4-4.5 wt. % |
| Fragrance | 0-1 wt. % | 0-1 wt. % | 0-1 wt. % |
| Coloring Agent | 0.01-0.02 wt. % | 0.01-0.02 wt. % | 0-0.02 wt. % |
| Carrier film | 35-45 wt. % | 35-45 wt. % | 35-45 wt. % |

HLAS is an anionic surfactant known as sodium dodecyl benzene sulfonate. IPA is known as isopropyl alcohol. Surfonic L12-8™ is a non-ionic surfactant that which is the eight-mole ethoxylate of linear, primary 10-12 carbon number alcohol. Surfonic L12-8™ is offered by Huntsman. Bio-terge™ is an anionic surfactant that is an aqueous solution of sodium olefin sulfonate. Bio-terge™ is offered by Stepan Company. Steol CS460™ is an anionic surfactant that is a sodium laureth sulfate. Steol CS460™ is offered by Stepan Company. The alcohols and water are generally used as solvents. Pine oil is an antimicrobial agent or cleaning agent. The hydroxides are also antimicrobial agent or cleaning agent, but can also function as pH adjustors. The acids primarily function as pH adjustors.

The carrier film can be formed of any number of different water soluble polymers. Non-limiting examples include hydroxypropyl methylcellulose and methylcellulose polymers that are offered by Dow Chemical under the name Methocel™. Other water soluble polymers that can be used include cellulose derivatives, polyvinylpyrrolidone, acrylate polymers, alcohol polymers, alginates, starches, glycerin, proteins, gums, polysaccharides, sorbitol, seaweed, synthetic polymers, polystyrene sulfonates, and polyethyleneimines. The water soluble strip can include one or more plasticisers to modify the properties of the water soluble polymers; however, this is not required.

The actives and/or additives used in the water soluble strip can be coated on the carrier film and/or incorporated into the carrier film. A majority of the actives in the water soluble strip can be partially or fully encapsulated in the polymer that forms the carrier strip so as to limit exposure of the actives to human touch when the water soluble strip is briefly handled; however, this is not required.

Although not illustrated in the three pine oil examples, the water soluble strip can optionally include heat forming agent and/or degrading accelerator. Non-limiting advantages of adding such materials to the water soluble strip have been previously described. The heat forming agent and/or degrading accelerator can also be used to produce or increase the formation of suds in the cleaning solution, if sud formation is desired. The heat forming agent and/or degrading accelerator can also be used to produce or enhance fizzing action which can provide a visual indication to a user that the water soluble film is dissolving in the water. A coloring agent (e.g., dye, thermochromic agent, etc.) can be included in the water soluble strip to cause the water to change color as the water soluble strip dissolves or degrades in the water; however, this is not required. The color change of the water can provide a visual indicator to a user that the water soluble film is dissolving or has dissolved in the water. Fragrance can be optionally added to the water soluble strip. The polymer system used to form the carrier film of the water soluble strip is generally selected so that over 80% of the water soluble film dissolves or degrades in the presence of water in less than about 3 minutes, typically less than about 1.5 minutes, and more typically less than about 1 minute. Stirring and/or shaking a container than includes the water soluble strip may result in shorter times for dissolving or degrading the water soluble strip.

Each water soluble strip can be individually packaged so that each water soluble strip represents a single use to a user. Furthermore, the packaging can be used to limit exposure of the actives and/or additives in the water soluble strip to oxygen and water until the strip is ready to be used.

The water soluble strip generally has a thickness of about 3-10 mills, a length of about 4-12 cm, and a width of about 2-6 cm. The color of the strip is non-limiting. The surface texture of the strip is generally smooth; however, this is not required.

Laundry Cleaning Strip

The water soluble strip can be formulated for use in a washing machine for the cleaning of laundry. Common liquid and granular cleaners such as Tide™, Clorox 2™ and the like are used to clean laundry in a washing machine. These liquid and granular cleaners are commonly poured into washing machine prior to or after the washing machine has been started. Although the liquid and granular cleaners generally include information about the desired amount of cleaner to be used in the washing machine, users may not read or properly follow the instructions, thereby inserting too little or too much cleaner into the washing machine. Furthermore, the pouring of liquid and granular cleaners into a washing machine can sometimes be messy due to inadvertent spills. Also, the pouring of liquid and granular cleaners from large, bulky and/or heavy containers can be difficult for some users.

The use of the water soluble strip of the present invention overcomes many or all of these deficiencies. The water soluble strip is preformulated to clean a standard load of laundry in washing machine, thus measuring of the liquid or granular cleaner is eliminated. If larger laundry loads are to be washed, two of more strips can be inserted into the washing machine. The water soluble strip is a solid, small and light weigh strip that is easy to handle and use. The water soluble strip is also much easier to handle and more convenient to store due to the small size and light weight of the strip. In some instances, the shelf life of the water soluble strip may be longer than certain types of liquid laundry cleaners.

The types and amount of actives in the water soluble strip is non-limiting. As such, many different types of laundry cleaning strip can be formed in accordance with the present invention. Water soluble films such as, but not limited to, PVOH, can be successfully used with various types of bleaching agents. Water soluble films such as, but not limited to, poly(vinyl pyrrolidone), can be successfully used with peroxide actives. Non-limiting examples of one type of laundry cleaning water soluble strip is set forth below.

| Component | Example 1 | Example 2 | Example 3 |
|---|---|---|---|
| Actives | 2-70 wt. % | 3-65 wt. % | 5-60 wt. % |
| Additives | 0-65 wt. % | 1-55 wt. % | 4-45 wt. % |
| Solvents | 0-40 wt. % | 0-30 wt. % | 0-25 wt. % |
| Carrier film | 5-60 wt. % | 5-50 wt. % | 10-50 wt. % |

| Component | Example 4 | Example 5 | Example 6 |
|---|---|---|---|
| Actives (other than heat forming agent and degrading accelerator) | 5-60 wt. % | 20-55 wt. % | 30-55 wt. % |
| Heat Forming Agent | 0-30 wt. % | 0-25 wt. % | 5-20 wt. % |
| Degrading Accelerator | 0-20 wt. % | 1-15 wt. % | 2-12 wt. % |
| Alcohol | 0-20 wt. % | 0-10 wt. % | 0-5 wt. % |
| Water | 0-50 wt. % | 0-40 wt. % | 0-30 wt. % |
| Coloring Agent | 0-5 wt. % | 0-3 wt. % | 0-1 wt. % |
| Fragrance | 0-4 wt. % | 0-3 wt. % | 0-3 wt. % |
| Carrier film | 10-45 wt. % | 25-40 wt. % | 30-40 wt. % |

The type of active used in the above formulations is non-limiting. Examples of actives that can be used are hypochlorites and peroxides. The active can also or alternatively include one or more surfactant or detergent agents, enzymes and/or many other types of cleaning agents. One specific type of laundry cleaning strip is set forth as follows:

| Component | Example 7 |
|---|---|
| Calcium hypochlorite | 27-34 wt. % |
| Sodium hydroxide | 5-9 wt. % |
| Sodium lauryl ether sulfate | 12-18 wt. % |
| Peroxide compound | 0-15 wt. % |
| Sodium percarbonate | 5-9 wt. % |
| Water | 0-15 wt. % |
| Fragrance | 0-2 wt. % |
| Coloring Agent | 0-0.1 wt. % |
| Carrier film | 35-40 wt. % |

Calcium hypochlorite and peroxide compound, when used, are actives in the form of a bleaching compound. Sodium lauryl ether sulfate is an active in the form of a surfactant. Sodium hydroxide is a pH adjustor, but may also function as a cleaning agent. Sodium percarbonate is a degrading accelerator, but may also function as a cleaning agent, Water, when used, is a solvent.

The carrier film can be formed of any number of different water soluble polymers. The polymers selected are generally stable in the presence of bleaching compounds and peroxides, when such compounds are use, and typically have a pH resistant to a pH range of about 4-12. Non-limiting examples of polymers that can be used include acrylic homopolymers and copolymers, copolymers of acrylamide and sodium acrylate, copolymer of acrylamide and sodium acrylate, polyvinyl pyrrolidone, polystyrene sulfonates and polyethyleneimines. The water soluble strip can include one or more plasticisers to modify the properties of the water soluble polymers; however, this is not required.

The actives and/or additives used in the water soluble strip can be coated on the carrier film and/or incorporated into the carrier film. A majority of the actives in the water soluble strip can be partially or fully encapsulated in the polymer that forms the carrier strip so as to limit exposure of the actives to human touch when the water soluble strip is briefly handled; however, this is not required.

Although not illustrated in the laundry water soluble strip can optionally include a heat forming agent. Non-limiting advantages of adding such materials to the water soluble strip have been previously described. A coloring agent (e.g., dye, thermochromic agent, etc.) can be included in the water soluble strip to cause the water to change color as the water soluble strip dissolves or degrades in the water; however, this is not required. The color change of the water can provide a visual indicator to a user that the water soluble film is dissolving or has dissolved in the water. Fragrance can be optionally added to the water soluble strip. The polymer system used to form the carrier film of the water soluble strip is generally selected so that over 80% of the water soluble film dissolves or degrades in the presence of water in less than about 3 minutes, typically less than about 1.5 minutes, and more typically less than about 1 minute.

Each water soluble strip can be individually packaged so that each water soluble strip represents a single use to a user. Furthermore, the packaging can be used to limit exposure of the actives and/or additives in the water soluble strip to oxygen and water until the strip is ready to be used.

The water soluble strip generally has a thickness of about 3-15 mills, a length of about 4-20 cm, and a width of about 2-15 cm. The color of the strip is non-limiting. The surface texture of the strip is generally smooth; however, this is not required.

Laundry Snot Stain Cleaning Strip

The water soluble strip can be formulated for use as a spot stain cleaner to apply to difficult to remove stains on laundry items prior to placing the laundry item in a washing machine or hand washing the laundry item. Common liquid and spray spot cleaners such as Shout™, Spray-And-Wash™ and the like are used to stains on laundry. These liquid and spray cleaners are commonly poured or sprayed onto a laundry item prior to the laundry item being placed into a washing machine or into a sink for hand washing. The pouring or spraying of the cleaner on one or more regions of a laundry item can sometimes be messy due to inadvertent spills and over spraying. Also, the act pouring of liquid or spraying the cleaner can be difficult for some users. The use of the water soluble strip of the present invention overcomes many or all of these deficiencies. The water soluble strip is preformulated to clean stains on laundry items. The water soluble strip is merely applied to the location of the stain and may contain an adhesive or a polymer which acts as an adhesive to make the strip adhere to the clothing or textile surface. No pouring or spraying of cleaner is required. The water soluble strip is a solid, small and light weigh strip that is easy to handle and use. The water soluble strip is also much easier to handle and more convenient to store due to the small size and light weight of the strip. In some instances, the shelf life of the water soluble strip may be longer than certain types of liquid laundry cleaners.

The water soluble strip can be applied to a pre-wetted region of the laundry item that includes the stained region; however, this is not required. The water soluble strip can be post wetted after the water soluble strip is applied to the region of the laundry item that includes the stain; however, this is not required. The pre-wetting or post-wetting can be used to secure the water soluble strip to the laundry item, and/or begin the stain cleaning process by the water soluble strip. In one non-limiting design, the water soluble strip is designed to adhere to a pre or post wetted region of a laundry item and then fully clean and dissolve after the laundry item is place in the washing machine or during the hand washing process.

The water soluble strip can include a removable protective cover, such as a backing layer and/or may be individually packaged. The protective cover may be designed to be partially or fully removed by the user to begin the reaction of one or more actives (e.g., heat forming agent, etc.) with the surrounding oxygen or water; however, this is not required.

The types and amount of actives in the water soluble strip is non-limiting. As such, many different types of laundry stop cleaning strips can be formed in accordance with the present invention. Indeed, different laundry stop cleaning strips can be formulated to clean certain types of stains or a class of stains. Non-limiting examples of one type of laundry spot cleaning water soluble strip is set forth below.

| Component | Example 1 | Example 2 | Example 3 |
|---|---|---|---|
| Actives | 2-60 wt. % | 5-50 wt. % | 10-50 wt. % |
| Additives | 0-50 wt. % | 0-40 wt. % | 2-35 wt. % |
| Solvents | 0-40 wt. % | 0-30 wt. % | 5-25 wt. % |
| Carrier film | 5-60 wt. % | 5-50 wt. % | 10-50 wt. % |
| **Component** | **Example 4** | **Example 5** | **Example 6** |
| Actives (other than heat forming agent and degrading accelerator) | 1-35 wt. % | 5-30 wt. % | 10-25 wt. % |
| Heat Forming Agent | 0-25 wt. % | 5-25 wt. % | 10-20 wt. % |
| Degrading Accelerator | 0-20 wt. % | 0-15 wt. % | 1-15 wt. % |
| Alcohol | 0-25 wt. % | 0-20 wt. % | 10-20 wt. % |
| Water | 0-50 wt. % | 0-40 wt. % | 0-30 wt. % |
| Coloring Agent | 0-5 wt. % | 0-3 wt. % | 0-1 wt. % |
| Fragrance | 0-4 wt. % | 0-3 wt. % | 0-3 wt. % |
| Carrier film | 10-45 wt. % | 25-40 wt. % | 30-40 wt. % |

The type of active used in the above formulations is non-limiting. Examples of actives that can be used are surfactants and enzymes. The active can also or alternatively include one or more bleaching agent and/or many other types of cleaning agents. Two specific types of laundry spot cleaning strip are set forth as follows:

| Component | Example 7 | Example 8 |
|---|---|---|
| Amylase | 1-3 wt. % | 1-3 wt. % |
| Protease | 1-3 wt. % | 1-3 wt. % |
| Alcohol ethoxylate | 12-20 wt. % | 12-20 wt. % |
| Ethanol | 0-20 wt. % | 12-20 wt. % |
| Heat Forming Agent | 12-20 wt. % | 0-20 wt. % |
| Water | 0-20 wt. % | 0-20 wt. % |

-continued

| Component | Example 7 | Example 8 |
|---|---|---|
| Fragrance | 0-2 wt. % | 0-2 wt. % |
| Coloring Agent | 0-0.1 wt. % | 0-0.1 wt. % |
| Carrier film | 60-70 wt. % | 60-70 wt. % |

The amylase and protease are actives in the form of enzymes. The alcohol ethoxylate is an active in the form of non-ionic surfactant. One types of alcohol ethoxylate that can be used has a designation of C12 5 EO. The ethanol is a solvent, but can also act as a cleaning agent. The heat generating agent, when used, can include a mixture of activated carbon, iron powder and metal salt; however, other types of heat generating compound can be used.

The carrier film can be formed of any number of different water soluble polymers. The polymers selected are generally stable in the presence of enzymes and other actives included in the water soluble strip. Non-limiting examples of polymers that can be used include carboxymethylcellulose, polyvinylpyrrolidone, polyvinyl alcohol, and various types of starches. The water soluble strip can include one or more plasticisers (e.g., propylene glycol, sorbitol, glycerin, sodium lactate, etc.) to modify the properties of the water soluble polymers; however, this is not required.

The actives and/or additives used in the water soluble strip can be coated on the carrier film and/or incorporated into the carrier film. A majority of the actives in the water soluble strip can be partially or fully encapsulated in the polymer that forms the carrier strip so as to limit exposure of the actives to human touch when the water soluble strip is briefly handled; however, this is not required.

When the laundry spot cleaning water soluble strip includes a heat forming agent, the localized heat that applied to the stained region of the laundry can facilitate in removing the stain and/or increase the activity of one or more actives on and about the stain. As illustrated in FIG. 1, the concentration of the heat forming agent in the water soluble strip can be used to control the degree of temperature increase as the water soluble strip dissolves. As also illustrated in FIG. 1, different types of heat forming agent can result in different amounts of temperature increases for a certain concentration of heat forming agent. FIG. 1 illustrates two different types of Tweens® (polysorbate esters) that are used as heat forming agents. Tween® 20 results in a slightly greater temperature increase as compared to Tween® 80. Also, FIG. 1 illustrates that when the concentration of the Tweens® in the water soluble film exceeds about 65-70 weight percent, the amount of temperature increase levels off or decreases. A coloring agent (e.g., dye, thermochromic agent, etc.) can be included in the water soluble strip to cause the water to change color as the water soluble strip dissolves or degrades in the water; however, this is not required. The color change of the water can provide a visual indicator to a user that the water soluble film is dissolving or has dissolved in the water. Fragrance can be optionally added to the water soluble strip. The polymer system used to form the carrier film of the water soluble strip is generally selected so that over 80% of the water soluble film dissolves or degrades in the presence of water in less than about 3 minutes, typically less than about 1.5 minutes, and more typically less than about 1 minute.

Each water soluble strip can be individually packaged so that each water soluble strip represents a single use to a user. Furthermore, the packaging can be used to limit exposure of the actives and/or additives in the water soluble strip to oxygen and water until the strip is ready to be used. The water soluble strip can optionally include a removable protective cover that enables a user to activate the water soluble strip before or after the strip is applied to a stained region on the laundry item The water soluble strip generally has a thickness of about 3-10 mills, a length of about 2-10 cm, and a width of about 2-8 cm. The color of the strip is non-limiting. The surface texture of the strip is generally smooth; however, this is not required.

Drain Cleaning Strip

The water soluble strip can be formulated for use as a drain cleaning cleaner to unclog clogged drains. Common liquid and granular drain cleaners such as Liquid Plumber™ and the like are used to clear clogged drains. These liquid and granular drain cleaners are commonly poured into a clogged drain or region about a clogged drain. The pouring of the drain cleaner into a clogged drain can sometimes be messy due to inadvertent spills. Also, the act pouring of the liquid or granular drain cleaner can be difficult for some users. The use of the water soluble strip of the present invention overcomes many or all of these deficiencies. The water soluble strip is preformulated to unclog commonly plugged drains. The water soluble strip is merely inserted into the clogged drain or place in a region about the clogged drain. No pouring of drain cleaner is required. The water soluble strip is a solid, small and light weigh strip that is easy to handle and use. The water soluble strip is also much easier to handle and more convenient to store due to the small size and light weight of the strip. In some instances, the shelf life of the water soluble strip may be longer than certain types of liquid drain cleaners.

The types and amount of actives in the water soluble strip is non-limiting. As such, many different types of drain cleaning strips can be formed in accordance with the present invention. Non-limiting examples of one type of laundry spot cleaning water soluble strip is set forth below.

| Component | Example 1 | Example 2 | Example 3 |
|---|---|---|---|
| Actives | 20-85 wt. % | 30-80 wt. % | 40-70 wt. % |
| Additives | 0-50 wt. % | 0-40 wt. % | 1-30 wt. % |
| Solvents | 0-30 wt. % | 0-25 wt. % | 1-20 wt. % |
| Carrier film | 5-55 wt. % | 10-50 wt. % | 10-50 wt. % |
| **Component** | **Example 4** | **Example 5** | **Example 6** |
| Actives (other than heat forming agent and degrading accelerator) | 45-70 wt. % | 50-70 wt. % | 55-70 wt. % |
| Heat Forming Agent | 0-40 wt. % | 0-35 wt. % | 5-30 wt. % |
| Degrading Accelerator | 0-30 wt. % | 0-25 wt. % | 1-20 wt. % |
| Water | 0-30 wt. % | 0-35 wt. % | 0-20 wt. % |
| Coloring Agent | 0-5 wt. % | 0-3 wt. % | 0-1 wt. % |
| Fragrance | 0-4 wt. % | 0-3 wt. % | 0-3 wt. % |
| Carrier film | 20-50 wt. % | 25-45 wt. % | 30-45 wt. % |

The type of active used in the above formulations is non-limiting. Examples of actives that can be used are hypochlorites, peroxides, carbonates and surfactants. The active can also or alternatively include one or more enzymes, acids, bases and/or many other types of cleaning agents. One specific type of drain cleaning strip is set forth as follows:

| Component | Example 7 |
|---|---|
| Calcium hypochlorite | 30-40 wt. % |
| Sodium hydroxide | 7-15 wt. % |
| Sodium percarbonate | 7-15 wt. % |

-continued

| Component | Example 7 |
|---|---|
| Sodium lauryl ether sulfate | 2-8 wt. % |
| Peroxide compound | 0-20 wt. % |
| Water | 0-14 wt. % |
| Fragrance | 0-2 wt. % |
| Coloring Agent | 0-0.1 wt. % |
| Carrier film | 30-40 wt. % |

Calcium hypochlorite and peroxide compound, when used, are actives in the form of a bleaching compound. Sodium lauryl ether sulfate is an active in the form of a surfactant. Sodium hydroxide is a pH adjustor, but may also function as a cleaning agent. Sodium percarbonate is a degrading accelerator, but may also function as a cleaning agent. Water, when used, is a solvent.

The carrier film can be formed of any number of different water soluble polymers. The polymers selected are generally stable in the presence of bleaching compounds and peroxides, when such compounds are use, and typically have a pH resistant to a pH range of about 4-12. Non-limiting examples of polymers that can be used include acrylic homopolymers and copolymers, copolymers of acrylamide and sodium acrylate, copolymer of acrylamide and sodium acrylate, polyvinyl pyrrolidone, polystyrene sulfonates and polyethyleneimines. The water soluble strip can include one or more plasticisers to modify the properties of the water soluble polymers; however, this is not required.

The actives and/or additives used in the water soluble strip can be coated on the carrier film and/or incorporated into the carrier film. A majority of the actives in the water soluble strip can be partially or fully encapsulated in the polymer that forms the carrier strip so as to limit exposure of the actives to human touch when the water soluble strip is briefly handled; however, this is not required.

Although not illustrated in the drain cleaning water soluble strip can optionally include heat forming agent and/or degrading accelerator. Non-limiting advantages of adding such materials to the water soluble strip have been previously described. The heat forming agent and/or degrading accelerator can also be used to produce or enhance fizzing action which can provide a visual indication to a user that the water soluble film is dissolving in the water. A coloring agent (e.g., dye, thermochromic agent, etc.) can be included in the water soluble strip to cause the water to change color as the water soluble strip dissolves or degrades in the water; however, this is not required. The color change of the water can provide a visual indicator to a user that the water soluble film is dissolving or has dissolved in the water. Fragrance can be optionally added to the water soluble strip. The polymer system used to form the carrier film of the water soluble strip is generally selected so that over 80% of the water soluble film dissolves or degrades in the presence of water in less than about 3 minutes, typically less than about 1.5 minutes, and more typically less than about 1 minute.

Each water soluble strip can be individually packaged so that each water soluble strip represents a single use to a user. Furthermore, the packaging can be used to limit exposure of the actives and/or additives in the water soluble strip to oxygen and water until the strip is ready to be used.

The water soluble strip generally has a thickness of about 3-15 mills, a length of about 4-20 cm, and a width of about 2-15 cm. The color of the strip is non-limiting. The surface texture of the strip is generally smooth; however, this is not required.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

We claim:

1. A laundry stain cleaning strip comprising:

A. a backing layer; and

B. an adhesive strip adjacent to said backing layer comprising:

(i) at least 30% by weight of one or more water soluble polymers selected from the group consisting of: cellulose derivatives, polyvinylpyrrolidone, acrylate polymers, alcohol polymers, alginates, starches, glycerin, proteins, gums, polysaccharides, sorbitol, seaweed, synthetic polymers, proteins, polystyrene sulfonates, polyampholytes, cationic polymers, and polyethyleneimires and any combinations or mixtures thereof;

(ii) one or more surfactants selected from the group consisting of: anionic surfactants and non-ionic surfactants and any mixtures or combinations thereof;

(iii) optionally, one or more additives selected from the group consisting of: thermochromic agents, dyes, pigments, bleaching agents, antimicrobial agents, enzymes, defoamers, thickener, anti-dye transfer agents, fragrances, preservatives, opacifiers, pH adjusters, sequestrants, degrading accelerators, clarifiers and humectants;

(iv) one or more solvents selected from the group consisting of: water, acetone, alcohol, ethyl acetate, glycerin, glycol, triacetin, triglycerides, and any mixtures or combinations thereof; and wherein said adhesive strip adheres to a textile and dissolves in water releasing one or more of said surfactants and said solvents.

2. The laundry stain cleaning strip as defined in claim 1, wherein said water soluble polymer includes one or more polymers selected from the group consisting of: polyvinyl alcohol, polyacrylic acid, polyethylene glycol, poly(DADMAC), hydroxypropyl cellulose and methylcellulose polymers, carboxymethylcellulose, hydroxyethylcellulose and any combinations or mixtures thereof.

3. The laundry stain cleaning strip as defined in claim 1, wherein said surfactant is a nonionic surfactant.

4. The laundry stain cleaning strip as defined in claim 3, wherein said nonionic surfactant is an alcohol ethoxylate.

5. The laundry stain cleaning strip as defined in claim 3, wherein said nonionic surfactant is selected from the group consisting of: sorbitan monooleates, sorbitan derivatives or any mixtures or combinations thereof.

6. The laundry stain cleaning strip as defined in claim 1, wherein said water soluble polymer includes one or more polymers selected from the group consisting of: polyvinyl alcohol, polyacrylic acid and any combinations or mixtures thereof.

7. The laundry stain cleaning strip as defined in claim 1, wherein said adhesive strip further comprises an additive which is a plasticizer and is selected from the group consisting of: propylene glycol, glycerol, d-panthenol, sodium lactate, polyethylene glycol, sorbitol, glycerol esters, partially hydrogenated rosin and any mixtures or combinations thereof.

8. The laundry stain cleaning strip as defined in claim 1, wherein said surfactant is an anionic surfactant.

9. The laundry stain cleaning strip as defined in claim 8, wherein said anionic surfactant is selected from the group consisting of: amine oxides, alkylbenzene sulfonates, alkane sulfonates, and any combinations or mixtures thereof.

10. The laundry stain cleaning strip as defined in claim 1, wherein said backing layer is a non-active layer of material which aids in easy application of the adhesive strip to the textile material.

11. A laundry stain cleaning strip comprising:

A. a backing layer;

B. an adhesive strip comprising:

(i) at least 30% by weight of one or more water soluble polymers selected from the group consisting of: cellulose derivatives, polyvinylpyrrolidone, acrylate polymers, alcohol polymers, alginates, starches, glycerin, proteins, gums, polysaccharides, sorbitol, seaweed, synthetic polymers, proteins, polystyrene sulfonates, polyampholytes, cationic polymers, and polyethyleneimines and any combinations or mixtures thereof; and (ii) one or more solvents selected from the group consisting of: water, acetone, alcohol, ethyl acetate, glycerin, glycol, triacetin, triglycerides, and any mixtures or combinations thereof; and C. two or more cleaning strips, adjacent to the adhesive strip, each comprising:

(i) one or more surfactants;

(ii) optionally, one or more additives selected from the group consisting of: bleaching agents, antimicrobial agents, enzymes, plasticizers and any combinations or mixtures thereof; and (iii) one or more solvents selected from the group consisting of: water, acetone, alcohol, ethyl acetate, glycerin, glycol, triacetin, triglycerides, and any mixtures or combinations thereof.

12. The laundry stain cleaning strip as defined in claim 11, wherein said surfactant is an alcohol ethoxylate.

13. The laundry stain cleaning strip as defined in claim 11, wherein said water soluble polymer is selected from the group consisting of: polyvinyl alcohol, polyacrylic acid, polyethylene glycol, poly(DADMAC), hydmxypropyl cellulose and methylcellulose polymers, carboxymethylcellulose, hydroxyethylcellulose and any combinations or mixtures thereof.

14. The laundry stain cleaning strip as defined in claim 1, further comprising an additive which is a plasticizer.

15. The laundry stain cleaning strip as defined in claim 14, wherein said plasticizer is a glycerol.

16. A laundry stain cleaning strip comprising:

A. a backing layer; and

B. an adhesive strip comprising:

(i) at least 30% by weight of one or more water soluble polymers selected from the group consisting of: cellulose derivatives, polyvinylpyrrolidone, acrylate polymers, alcohol polymers, alginates, starches, glycerin, proteins, gums, polysaccharides, sorbitol, seaweed, synthetic polymers, proteins, polystyrene sulfonates, polyampholytes, cationic polymers, and polyethyleneimines and any combinations or mixtures thereof;

(ii) optionally, one or more surfactants selected from the group consisting of: anionic and non-ionic surfactants and any combinations or mixtures thereof, and (iii) one or more solvents selected from the group consisting of: water, acetone, alcohol, ethyl acetate, glycerin, glycol, triacetin, triglycerides, and any mixtures or combinations thereof;

C. a first cleaning strip, adjacent to said adhesive strip, comprising:

(i) one or more surfactants; and (ii) one or more solvents selected from the group consisting of: water, acetone, alcohol, ethyl acetate, glycerin, glycol, triacetin, triglycerides, and any mixtures or combinations thereof; and D. a second cleaning strip, adjacent to said first cleaning strip, comprising:

(i) one or more additives selected from the group consisting of: thermochromic agents, dyes, pigments, bleaching agents, antimicrobial agents, enzymes, defoamers, thickener, anti-dye transfer agents, fragrances, preservatives, opacifiers, pH adjusters, sequestrants, degrading accelerators, clarifiers and humectants; and (ii) one or more solvents selected from the group consisting of: water, acetone, alcohol, ethyl acetate, glycerin, glycol, triacetin, triglycerides, and any mixtures or combinations thereof.

17. The laundry stain cleaning strip as defined in claim 16, wherein said water soluble polymer includes one or more polymers selected from the group consisting of polyvinyl alcohol, polyacrylic acid, polyethylene glycol, poly(DADMAC), hydroxypropyl cellulose and methylcellulose polymers, carboxymethylcellulose, hydroxyethylcellulose and any combinations or mixtures thereof.

18. The laundry stain cleaning strip as defined in claim 1, wherein said cleaning strip comprises less than 20% by weight of one or more surfactants.

19. The laundry stain cleaning strip as defined in claim 11, wherein each of said cleaning strip comprises less than 20% by weight of one or more surfactants.

20. The laundry stain cleaning strip as defined in claim 16, wherein said first cleaning strip comprises less than 20% by weight of one or more surfactants.

* * * * *